US010930225B2

(12) United States Patent
Ji et al.

(10) Patent No.: US 10,930,225 B2
(45) Date of Patent: Feb. 23, 2021

(54) DISPLAY CONTROL METHOD AND APPARATUS OF BACKLIGHT SOURCES, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Zhihua Ji, Beijing (CN); Tiankuo Shi, Beijing (CN); Xiaomang Zhang, Beijing (CN); Yilang Sun, Beijing (CN); Lingyun Shi, Beijing (CN); Wenyu Li, Beijing (CN); Yanhui Xi, Beijing (CN); Chuanjun Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijng (CN)

( * ) Notice: Subject to any disclaimer, the term of this patent is extended or adjusted under 35 U.S.C. 154(b) by 0 days.

(21) Appl. No.: 16/291,707

(22) Filed: Mar. 4, 2019

(65) Prior Publication Data

US 2019/0355316 A1 Nov. 21, 2019

(30) Foreign Application Priority Data

May 18, 2018 (CN) ..... 201810482382.4

(51) Int. Cl.
*G09G 3/36* (2006.01)
*G09G 3/34* (2006.01)

(52) U.S. Cl.
CPC ..... *G09G 3/3426* (2013.01); *G09G 3/342* (2013.01); *G09G 3/36* (2013.01);
(Continued)

(58) Field of Classification Search
CPC ..... G09G 2330/021; G09G 2330/023; G09G 3/3426; G09G 3/36; G09G 2320/062;
(Continued)

(56) References Cited

U.S. PATENT DOCUMENTS

2010/0188433 A1 7/2010 Hiramatsu et al.
2010/0328537 A1* 12/2010 Davies ..... H04N 5/202 348/674
2011/0304597 A1* 12/2011 Hyatt ..... G09G 3/3611 345/207

FOREIGN PATENT DOCUMENTS

CN 101681611 A 3/2010
CN 103295553 A 9/2013
(Continued)

OTHER PUBLICATIONS

Zhang, Xitiao. "Local Dimming Algorithm for Direct-lit Type LED Backlight in LCD TVs", Hefei University of Technology, Apr. 2015. (Year: 2015).*

(Continued)

*Primary Examiner* — Julie Anne Watko
(74) *Attorney, Agent, or Firm* — Fay Sharpe LLP

(57) ABSTRACT

A display control method and apparatus of backlight sources, and a display device are provided. The method includes: determining a set backlight value of each backlight area according to a grayscale of an image to be displayed; determining an equivalent backlight luminance of each pixel point according to backlight source diffusion transmission parameter of the backlight module of the display device and the set backlight value of each backlight area; determining a compensation image according to the equivalent backlight luminance of each pixel point; and controlling the backlight module to turn on the backlight sources according to the set
(Continued)

backlight value of each backlight area, and controlling the display panel to display the image according to the compensation image.

19 Claims, 15 Drawing Sheets

(52) U.S. Cl.
CPC ..... *G09G 2320/062* (2013.01); *G09G 2320/0646* (2013.01); *G09G 2330/021* (2013.01); *G09G 2330/023* (2013.01); *G09G 2360/16* (2013.01)

(58) Field of Classification Search
CPC ..... G09G 3/3406; G09G 3/342; G09G 3/34; G09G 3/20; G09G 1/00; G09G 3/3607; G09G 3/3696; G09G 2320/066; G09G 2320/0626; G09G 2320/0633; G09G 2320/064; G09G 2320/0646; G09G 2320/0653; G09G 2320/0606; G09G 2320/06; G09G 2320/0233; G09G 2330/045; G09G 2330/02; G09G 2330/00
See application file for complete search history.

(56) References Cited

FOREIGN PATENT DOCUMENTS

| | | | | |
|---|---|---|---|---|
| CN | 103400554 | A | * | 11/2013 |
| CN | 103400554 | A | | 11/2013 |
| CN | 105869579 | A | | 8/2016 |
| CN | 107507580 | A | | 12/2017 |
| CN | 107799080 | A | | 3/2018 |
| EP | 2202717 | B1 | | 12/2013 |

OTHER PUBLICATIONS

Wei Huang, Local dimming algorithm and color gamut calibration for RGB LED blacklight LCD display; Optics & Laser Technology; vol. 2011, No. 43; Dec. 31, 2011; entire document.
First office action of Chinese application No. 201810482382.4 dated Jul. 30, 2019.
Xitiao Zhang; Local Dimming Algorithm for Direct-lit Type LED Backlight in LCD LCD TVs—Information Technology Section; Jun. 15, 2016, pp. 14-36.

* cited by examiner

DISPLAY CONTROL METHOD AND APPARATUS OF BACKLIGHT SOURCES, AND DISPLAY DEVICE

The present disclosure claims priority to Chinese Patent Application No.: 201810482382.4, filed on May 18, 2018 and titled "Dynamic Dimming Display Control Method and Apparatus of Backlight Sources", which is incorporated herein by reference in its entirety.

TECHNICAL FIELD

The present disclosure relates to a display control method and apparatus of backlight sources, and a display device.

BACKGROUND

A liquid crystal display device needs a light source supplied by a backlight module. In the conventional way of display, uniform backlight is provided and the luminance (grayscale) control of an output image is realized by controlling the deflection of liquid crystal. In recent years, with the enhancement of the computing power of a controller and the technical progress, the new idea of local dimming has been proposed. The same display effect as the full-luminance backlight is achieved by dimming the backlight corresponding to the darker area of a display image and correspondingly compensating the display signal of an LCD (Liquid Crystal Display) device during the display control. Therefore, the power consumption of the backlight can be reduced and the image quality contrast can be improved. Local dimming is particularly applicable to a battery powered display device, such as a mobile phone, a wearable device, etc., and especially for virtual reality (VR) devices, such as a VR helmet and VR glasses. Since wired power connection affects the operating experience, most of the display devices are powered by batteries currently. The power consumption of the backlight of the display device accounts for a considerable portion of the total energy consumption. Therefore, the use of the local dimming technology to save energy consumption is particularly significant for virtual reality devices.

SUMMARY

The present disclosure provides a display control method and apparatus of backlight sources, and a display device.

According to embodiments in an aspect of the present disclosure, there is provided a display control method of backlight sources, which is used for a display device comprising a display panel and a backlight module, wherein the backlight module comprises a plurality of backlight sources and a plurality of backlight areas each provided with one backlight source; and an area, corresponding to each of the backlight areas, on the display panel comprises a plurality of pixel points; the method comprises:

determining a set backlight value of each backlight area according to a grayscale of an image to be displayed;

determining an equivalent backlight luminance of each pixel point according to the backlight source diffusion transmission parameter of the backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image.

In some embodiments, said determining the set backlight value of each backlight area according to the grayscale of the image to be displayed comprises:

determining a backlight statistical value of each backlight area according to the grayscale of the image to be displayed; and segmenting the backlight statistical value of each backlight area to obtain the set backlight value of each backlight area.

In some embodiments, the backlight source is a 4-bit backlight source, and said segmenting the backlight statistical value of each backlight area to obtain the set backlight value of each backlight area comprises:

segmenting the backlight statistical value of each backlight area to obtain the set backlight value of each backlight area according to a set backlight value calculation formula, wherein the set backlight value calculation formula is:

$$BL_{set} = \begin{cases} 240 & BL_{sta} \geq 240 \\ \left[\frac{BL_{sta}}{16}\right]_{floor} * 16 & 240 > BL_{sta} > 16 \\ 16 & 1 < BL_{sta} \leq 16 \\ 0 & BL_{sta} = 0 \end{cases},$$

wherein, $BL_{set}$ represents the set backlight value; $BL_{sta}$ represents the backlight statistical value; $[\ ]_{floor}$ represents a rounding down operation.

In some embodiments, said determining the equivalent backlight luminance of each pixel point according to the backlight source diffusion transmission parameter of the backlight module of the display device and the set backlight value of each backlight area comprises:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area, and taking the total diffusion luminance as the equivalent backlight luminance of the pixel point.

In some embodiments, said determining the diffusion weights of A*B effective backlight sources that affect the luminance of the pixel point to the pixel point comprises:

calling the backlight source diffusion transmission parameter of the backlight module of the display device, wherein the backlight source diffusion transmission parameter is a point spread function y=f(x) that characterizes a relationship between a diffusion luminance y and a diffusion distance x;

determining the A*B effective backlight sources that affect the luminance of the pixel point according to the point spread function y=f(x); and determining the diffusion weights of the A*B effective backlight sources to the pixel point according to distances from the pixel point to the A*B effective backlight sources through the point spread function.

In some embodiments, the method further comprises:

obtaining illumination diffusion data of each backlight source of a plurality of backlight sources from different backlight areas of the display device, wherein the illumination diffusion data of each backlight source includes: luminance data of a plurality of pixel points on a screen of the display device and distance data representing a distance from a position of each pixel point to a position of a turned-on backlight source when each backlight source is turned on individually;

setting a luminance of a pixel point as a diffusion luminance y, setting a distance between a position of the pixel point and a backlight source as a diffusion distance x, and establishing a point spread function y=f(x) that characterizes the relationship between the diffusion luminance y and the diffusion distance x; and performing fitting to the point spread function according to the data corresponding to each pixel point to obtain various parameters in the point spread function, and taking the point spread function as the backlight source diffusion transmission parameter.

In some embodiments, said performing fitting to the point spread function according to the data corresponding to each pixel point to obtain various parameters in the point spread function comprises:

removing data corresponding to the pixel points whose luminance is less than a first luminance threshold from the illumination diffusion data, and taking the pixel points whose luminance is greater than or equal to the first luminance threshold as the effective pixel points, to obtain the data corresponding to the effective pixel points; and performing fitting to the point spread function according to the data corresponding to each effective pixel point to obtain various parameters in the point spread function.

In some embodiments, said performing fitting to the point spread function according to the data corresponding to each effective pixel point to obtain various parameters in the point spread function comprises:

performing statistical analysis on the data corresponding to each effective pixel point to obtain an average value of the diffusion luminance corresponding to each diffusion distance as an average diffusion luminance of each diffusion distance; and performing curve fitting according to each diffusion distance and the average diffusion luminance of each diffusion distance to obtain the various parameters in the point spread function.

In some embodiments, the point spread function y=f(x) is a piecewise polynomial function:

$$f(x)=\begin{cases}\sum_{n=0}^{k} a_n x^n & 0 \le x \le d1 \\ \sum_{n=0}^{k} b_n x^n & d1 \le x \le d2\end{cases},$$

wherein, k is a polynomial order, $a_n$ and $b_n$ are coefficients, d1 is a decomposition distance of the piecewise polynomial function, d2 is a maximum diffusion distance, which is a distance between a backlight source and an effective pixel point farthest from the backlight source, x is a diffusion distance, and y is a diffusion luminance.

In some embodiments, when each backlight source is turned on individually, the luminance data of the plurality of pixel points on the screen of the display device includes: luminance data of a plurality of pixel points at a plurality of different distances to the position of the turned-on backlight source in a horizontal direction and a vertical direction of the position of the turned-on backlight source, and the distance data representing the distance from the position of each pixel point to the position of the backlight source includes: distance data representing distances from a plurality of pixel points at a plurality of different distances to the turned-on backlight source in the horizontal direction and the vertical direction of the position of the turned-on backlight source.

In some embodiments, said determining the diffusion weights of A*B effective backlight sources that affect the luminance of the pixel point to the pixel point according to the backlight source diffusion transmission parameter comprises:

calling the backlight source diffusion transmission parameter of the backlight module of the display device, wherein the backlight source diffusion transmission parameter is the diffusion weights of the A*B effective backlight sources to the pixel point; and determining the diffusion weights of A*B effective backlight sources that affect the luminance of the pixel point to the pixel point according to the called backlight source diffusion transmission parameters.

In some embodiments, the method further comprises:

obtaining illumination diffusion data of each backlight source of a plurality of backlight sources from different backlight areas of the display device, wherein the illumination diffusion data of each backlight source includes: luminance data of a plurality of pixel points on a screen of the display device and distance data representing a distance from a position of each pixel point to a position of a turned-on backlight source when each backlight source is turned on individually;

setting a luminance of a pixel point as a diffusion luminance y, setting a distance between a position of the pixel point and a backlight source as a diffusion distance x, and establishing a point spread function y=f(x) that characterizes a relationship between the diffusion luminance y and the diffusion distance x; and performing fitting to the point spread function according to the data corresponding to each pixel point to obtain various parameters in the point spread function;

determining the A*B effective backlight sources that affect the luminance of the pixel point according to the point spread function y=f(x);

determining the diffusion weights of the A*B effective backlight sources to the pixel point according to distances from the pixel point to the A*B effective backlight sources through the point spread function; and taking the diffusion weights of the A*B effective backlight sources to the pixel point as the backlight source diffusion transmission parameter.

In some embodiments, said determining the target diffusion weights of the A*B effective backlight sources to the pixel point according to the determined diffusion weights of the A*B effective backlight sources to the pixel point comprises:

taking the determined diffusion weights of the A*B effective backlight sources to the pixel point as the target diffusion weights of the A*B effective backlight sources to the pixel point; and determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point comprises:

obtaining the total diffusion luminance of the A*B effective backlight sources at the pixel point according to the target diffusion weights of the A*B effective backlight sources to the pixel point through an equivalent backlight luminance calculation formula, and taking the total diffusion luminance as the equivalent backlight luminance $B^{L_{equ}}$ of the pixel point, wherein the equivalent backlight luminance calculation formula is:

$$BL_{equ} = \sum_{i=1}^{A}\sum_{j=1}^{B} f(x_{i,j})L_{i,j},$$

wherein $x_{i,j}$ represents the distance between a pixel point (i,j) and each effective backlight source, $f(x_{i,j})$ represents the diffusion weight of each effective backlight source to the pixel point (i,j), $L_{i,j}$ represents a luminance reference value of each effective backlight source, the luminance reference value is determined according to set backlight value of the backlight area where the effective backlight source is, and the pixel point (i,j) is any pixel point on the display panel.

In some embodiments, said determining the target diffusion weights of the A*B effective backlight sources to the pixel point according to the determined diffusion weights of the A*B effective backlight sources to the pixel point comprises:

performing normalization on the determined diffusion weights of the A*B effective backlight sources to the pixel point according to a normalization calculation formula to obtain a normalized diffusion weight of the A*B effective backlight sources to the pixel point;

taking the normalized diffusion weight of the A*B effective backlight sources to the pixel point as the target diffusion weights of the A*B effective backlight sources to the pixel point; and determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point comprises:

obtaining the total diffusion luminance of the A*B effective backlight sources at the pixel point according to the normalized diffusion weight of the A*B effective backlight sources to the pixel point through an equivalent backlight luminance calculation formula and taking the total diffusion luminance as the equivalent backlight luminance $B^{L_{equ}}$ of the pixel point, wherein the normalization calculation formula is:

$$\text{weight}(i, j) = f(x_{ij})/\text{sum_weight}, \ \text{sum_weight} = \sum_{i=1}^{A}\sum_{j=1}^{B} f(x_{ij});$$

the equivalent backlight luminance calculation formula is:

$$L_{equ} = \sum_{i=1}^{A}\sum_{j=1}^{B} \text{weight}(i, j)L_{i,j};$$

in which $x_{i,j}$ represents the distance between a pixel point (i,j) and each effective backlight source, $f(x_{i,j})$ represents the diffusion weight of each effective backlight source to the pixel point (i,j), weight(i,j) represents the normalized diffusion weight of each effective backlight source to the pixel point pixel point (i,j), $L_{i,j}$ represents a luminance reference value of each effective backlight source, the luminance reference value is determined according to set backlight value of the backlight area where the effective backlight source is, and the pixel point (i,j) is any pixel point on the display panel.

In some embodiments, said determining the compensation image according to the equivalent backlight luminance of each pixel point comprises:

calculating a compensation $v_{com}$ of each pixel point in the compensation image according to the equivalent backlight luminance of each pixel point through a compensation value calculation formula, wherein the compensation value calculation formula is:

$$v_{com} = 255^{*}\left[\frac{\frac{light_{ideal}*240}{bl} - light_{min}}{light_{max} - light_{min}}\right]^{1/gamma},$$

$$\text{wherein, } light_{ideal} = \left(\frac{v_{ori}}{255}\right)^{gamma} * (light_{max} - I_{en}) + I_{en},$$

in which $light_{ideal}$ represents a target luminance, $v_{ori}$ represents a maximum value among RGB three channels of the image to be displayed, gamma is an index of a relationship curve between the grayscale and the luminance, $light_{max}$ represents a maximum luminance value of a high-dynamic range system, $I_{en}$ represents an ambient luminance, $light_{max}$ and $light_{min}$ represent luminance values when all backlights are turned on and turned off respectively, and bl represents an equivalent backlight luminance expressed in grayscale.

According to embodiments of another aspect of the present disclosure, there is provided a display device, comprising a direct-lit backlight source, a display panel, a memory and one or more processors, wherein the memory stores therein one or more programs configured to be executed by the one or more processors, the one or more programs comprising instructions for performing following operations:

determining a set backlight value of each backlight area according to a grayscale of an image to be displayed;

determining an equivalent backlight luminance of each pixel point according to the backlight source diffusion transmission parameter of a backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image.

In some embodiments, the one or more programs further comprise instructions for performing following operations:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the determined diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point.

According to embodiments of another aspect of the present disclosure, there is provided a display control apparatus of backlight sources, which is applied to a display device comprising a display panel and a backlight module, wherein the backlight module comprises a plurality of backlight sources and a plurality of backlight areas, each of which is provided with one backlight source; and an area, corresponding to each of the backlight areas, on the display panel comprises a plurality of pixel points; the apparatus comprising:

one or more processors; and a memory;

wherein the memory stores therein one or more programs configured to be executed by the one or more processors, the one or more programs comprising instructions for performing following operations:

determining a set backlight value of each backlight area according to a grayscale of an image to be displayed;

determining an equivalent backlight luminance of each pixel point according to the backlight source diffusion transmission parameter of the backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image.

In some embodiments, the one or more programs further comprise instructions for performing following operations:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the determined diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point.

Embodiments of yet another aspect of the present disclosure provide a computer-readable storage medium, wherein the computer-readable storage medium is a non-volatile readable storage medium and stores instructions therein that, when the computer-readable storage medium operates in a processor, cause the processor to perform any of the above-mentioned display control methods of backlight sources.

Embodiments of yet another aspect of the present disclosure provide a computer program product, wherein the computer program product stores instructions therein that, when the computer program product operates in a computer, cause the computer to perform any of the above-mentioned display control methods of backlight sources.

Embodiments of yet another aspect of the present disclosure provide a chip comprising a logical programmable device and/or program instructions, wherein the chip operates to perform any of the above-mentioned display control methods of backlight sources.

BRIEF DESCRIPTION OF THE DRAWINGS

The above aspects and/or additional aspects and advantages of the present disclosure becomes apparent and understandable from the following descriptions of the embodiments with reference to the accompanying drawings.

DETAILED DESCRIPTION

Figure 1:
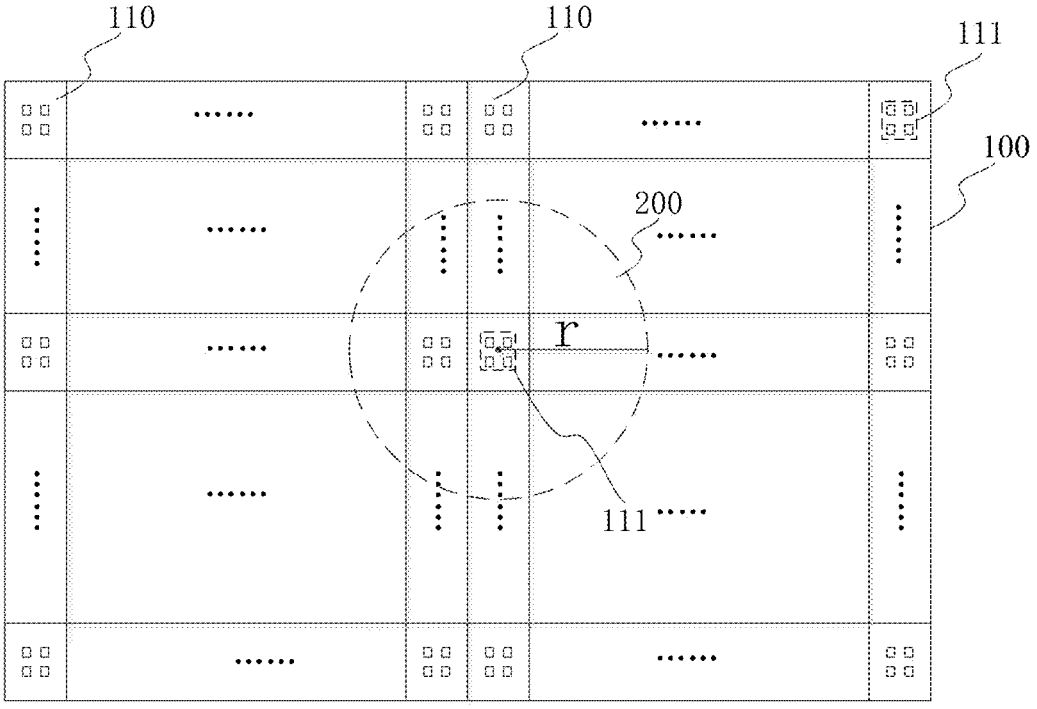
FIG. 1 is a schematic diagram of distribution of backlight sources of a direct-lit backlight module.

Reference will now be made in detail to exemplary embodiments, examples of which are illustrated in the accompanying drawings. The same or similar numbers represent the same or similar elements or elements having the same or similar functions throughout. The embodiments described below with reference to the accompanying drawings are exemplary, which are intended to explain the present disclosure rather than be understood to limit the present disclosure.

The method and apparatus of the embodiments of the present disclosure will be described in detail below with reference to the accompanying drawings.

Local dimming technology is mainly applied to a display apparatus of a direct-lit backlight lattice, for the purpose of achieving the effects of reducing the backlight power consumption and improving the image contrast by locally adjusting the luminance of each backlight area. The local dimming technology can be used for a liquid crystal display device with a direct-lit backlight module in which an LED (Light Emitting Diode) is used as the backlight source. As known to the inventors, at present, the luminance of backlight is set directly according to the grayscale of a display image, and the LCD compensation is performed according to the luminance of the backlight area at a pixel point. After the local dimming, various backlight sources have relatively great luminance difference, and the acquired LCD compensation image cannot effectively compensate the actual change of the backlight, which seriously affects the final display effect.

The backlight module of the current LCD device comprises a plurality of backlight sources and a plurality of backlight areas, each of which is provided with one backlight source. The area, corresponding to each backlight area, on the display panel comprises a plurality of pixel points. The resolution of the backlight areas is much lower than the display resolution (i.e., the pixel resolution of the display panel). The backlight areas may affect the backlight luminance (the backlight luminance refers to the luminance of light emitted from the backlight source) of each pixel point differently. In addition, the light emitted from each backlight source not only illuminates the area where the backlight source is located, but also affects the luminance of the area around the area where the backlight source is located. In the case of uniform backlight, the backlight can be, due to high luminance, approximately considered as uniform high-luminance backlight within the entire screen of the display device after passing through the light guide plate. After local dimming, the luminance difference of the backlight sources is relatively large, and an LED image can be correctly compensated only by performing accurate modeling on the diffusion and transmission of the backlight, thereby obtaining a desired display effect.

In addition, the number of the luminance levels (i.e., the backlight luminance levels) of the backlight source is generally much less than the number of the grayscale levels of a display image. For example, the grayscale level of a display image can be represented by 8 bits, which can achieve 256 grayscale levels. However, the luminance level of the backlight source may be represented by only 4 bits, with 16 levels being adjustable. In the case where the number of the luminance levels of the backlight source is less than the number of the grayscale levels of the display image, how to reduce the image distortion and realize precise LCD image compensation in the course of performing dynamic dimming display is also an urgent problem to be solved.

FIG. 1 is a schematic diagram of a distribution of backlight sources of a direct-lit backlight module. The backlight module 100 comprises a plurality of backlight areas 110, for example, M*N backlight areas. Assuming that the backlight source is an LED, the resolution of the backlight area in the current display device is generally much lower than the pixel resolution of the display panel due to factors such as the volume, heat generation and control of the LED. For example, the pixel resolution is W*H, where W and H can reach the order of magnitude of $10^2$ and $10^3$, and M and N are generally of the order of magnitude of 10. Each backlight area 110 is provided with one backlight source 111. The backlight source can be implemented by a light emitting diode (LED) or any other light emitting device. In the current technical condition, the backlight source is mainly implemented by LEDs, and each backlight source can be implemented by one or more LEDs. FIG. 1 is an example in which each backlight source 111 includes 4 LEDs.

For each backlight source, the illumination diffusion range is generally greater than the current backlight area (the current backlight area is an area where the backlight source is) and covers several surrounding backlight areas. The diffusion intensity and range of the backlight source are affected by many factors such as the size of the backlight source, the optical structure and the film material. For a certain type of display device, once the materials of structures such as the backlight source, the optical structure and the film material are determined, the backlight diffusion difference of various products is relatively small and can be described by the same function. In most cases, the backlight diffusion is isotropic in all directions, i.e., the diffusion range is the same in all directions.

When a plurality of light-emitting devices constituting each backlight source have the same luminance and are arranged in a center symmetric manner, all the light-emitting devices constituting the backlight source may be abstracted as a point light source in the center of the backlight area to facilitate modeling and calculation. In this case, the diffusion range of the backlight source is approximately regarded as a circular area. For example, the diffusion range of the backlight source 111 near the center shown in FIG. 1 is an area 200 having a radius of r. It should be noted that when the arrangement of the light-emitting devices constituting the backlight source is different, the diffusion range of the backlight source 111 may be of other shapes. For example, the diffusion range of a backlight source composed of a centrally symmetric 2*2 LEDs is circular, while the diffusion range of a backlight source composed of a rectangular arrangement of 3*2 LEDs may be elliptical. In the present disclosure, the backlight source having a circular diffusion range is taken as an example merely for the convenience of explaining the principle of the present disclosure, rather than limiting the variety of the backlight source. Those skilled in the art can, under the teaching of the present disclosure, acquire and calculate the point spread function of a backlight source whose diffusion range is elliptical or of other shapes, without departing from the scope of the present disclosure.

Figure 2:
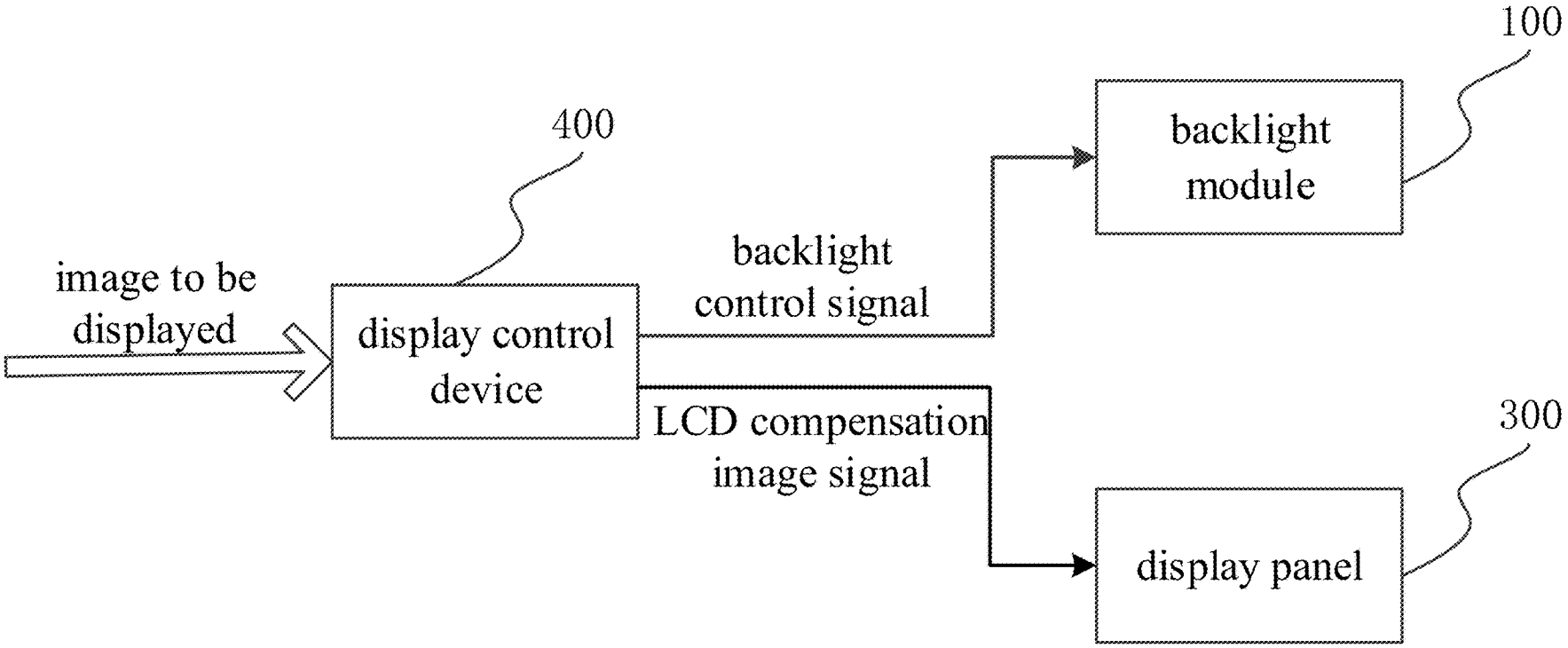
FIG. 2 is a schematic diagram of a display control principle of a local dimming display device according to an embodiment of the present disclosure.

FIG. 2 is a schematic diagram of a display control principle of a local dimming display device according to an embodiment of the present disclosure. When the local dimming display control is performed, the display control device 400 generates a backlight control signal and an LCD compensation image signal respectively after receiving an image to be displayed. That is, the local dimming display control mainly includes two aspects, i.e., backlight control and LCD compensation.

In the first aspect, for the backlight control, since the number of the adjustable luminance levels (for example, generally 4 bits and 16 levels adjustable) of the backlight source is generally different from the number of the grayscale levels (generally, 8 bits and 256 grayscales) of an image, it is necessary to come up with a reasonable method to set the luminance level of each backlight area according to the grayscale of the image, so as to ensure the high contrast and avoid the truncation of a compensation value (i.e., the theoretically calculated compensation value cannot exceed a displayable range of the display image) as much as possible. The compensation value refers to the value of compensation for the display effect of pixels. For example, the compensation value may be a lightness value. For the backlight control, the present disclosure provides a segmented displacement method in which a differential control strategy is adopted to set the backlight luminance level for backlight of pixel points within different grayscale ranges.

In the second aspect, for the LCD compensation, after the backlight luminance changes, an image signal of the display panel is correspondingly compensated to achieve the desired display effect. During the compensation process, the change in the backlight luminance of each pixel point relative to a static high-luminance backlight should be taken into consideration after the backlight luminance changes.

The inventors have noted that the backlight of each pixel point is not only affected by the backlight area at its opposite position, but also by its adjacent backlight areas. In addition, the luminance diffusion presents a very complex nonlinear characteristic with different distances to the backlight source. If the backlight diffusion transmission cannot be accurately modeled, ignoring the influence of the surrounding backlight sources on the luminance, an appropriate LCD compensation image cannot be obtained, which directly affects the quality of a final display image. For the LCD compensation, the present disclosure provides a method for modeling the diffusion transmission parameter of a backlight source by using a point spread function and for obtaining the diffusion transmission parameter of the backlight source by solving a model parameter via a backlight illumination experiment. On this basis, the diffusion transmission parameter of the backlight source is counted according to M*N backlight areas, and the pixel point diffusion backlight distribution of an image having a resolution of W*H is calculated. The image has the same resolution as the image to be displayed, and accordingly LCD image compensation is performed.

The change in the luminance of the backlight source with the diffusion distance can be described by a point spread function (PSF). In the optical system, the point spread function can be used to describe the optical field distribution of an output image of an input which is a point light source. As known to the inventors, the PSF of the backlight source is not used for dynamic dimming display control at present, and thus the method for acquiring the PSF for the backlight source of the display device has not been provided. According to the method provided by the present disclosure, the backlight diffusion weight (i.e., the diffusion weight from the backlight source to the pixel point) is calculated based on the pixel distance between the pixel point and the backlight source to equivalently simulate the diffusion situation of the backlight source. By performing the operation of turning on the screen by a single backlight source for multiple times and processing of screen data, the diffusion range of the backlight source in one backlight area is acquired, and the diffusion weights of different pixel distances to the center of the backlight source is accurately obtained. Therefore, in the subsequent display control, the equivalent backlight luminance corresponding to each pixel point may be calculated according to the diffusion weights, and the accurate compensation value of each pixel point in the LCD image may be obtained according to the luminance equivalence relation, or the like.

The method and apparatus of the embodiments of the present disclosure will be described in detail below with reference to the accompanying drawings.

Figure 3:
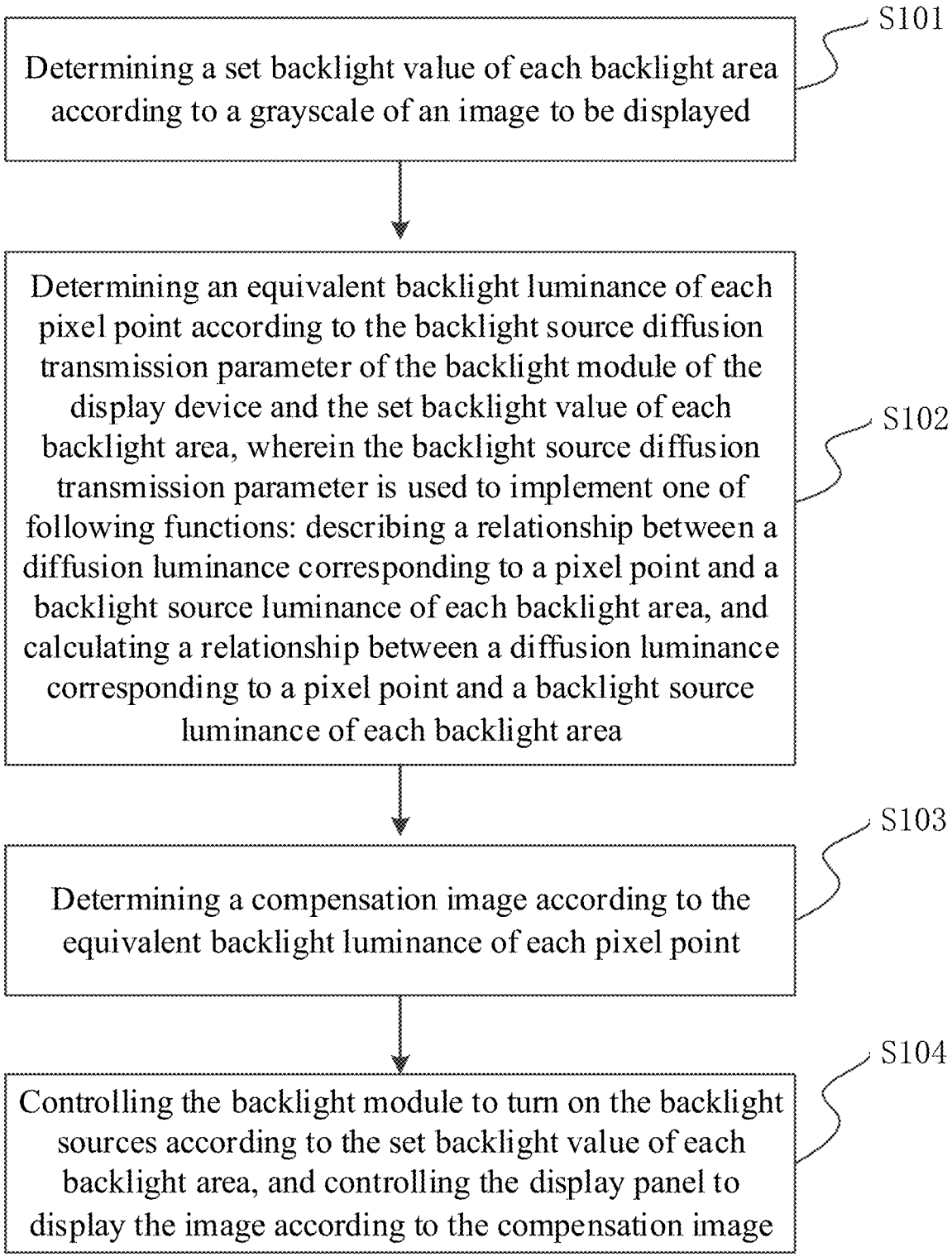
FIG. 3 is a flow chart of a display control method of a backlight source according to an embodiment of the present disclosure.

FIG. 3 is a flow chart of a display control method of backlight sources according to an embodiment of the present disclosure. The method is applied to a display device, which includes a display panel and a backlight module. The backlight module includes a plurality of backlight sources and a plurality of backlight areas, each of which is provided with one backlight source. An area, corresponding to each of the backlight areas, on the display panel includes a plurality of pixel points. The method of the backlight sources includes steps S101 to S104.

In step S101, a set backlight value of each backlight area is determined according to a grayscale of an image to be displayed.

In step S102, an equivalent backlight luminance of each pixel point is determined according to the backlight source diffusion transmission parameter of the backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area.

In step S103, a compensation image is determined according to the equivalent backlight luminance of each pixel point.

In step S104, the backlight module is controlled to turn on the backlight sources according to the set backlight value of each backlight area, and the display panel is controlled to display the image according to the compensation image.

Optionally, in step S101, determining the set backlight value of each backlight area according to the grayscale of the image to be displayed may include: determining a backlight statistical value of each backlight area according to the grayscale of the image to be displayed; and segmenting the backlight statistical value of each backlight area to obtain the set backlight value of each backlight area.

Optionally, the backlight source is a 4-bit backlight source, and segmenting the backlight statistical value of each backlight area to obtain the set backlight value of each backlight area may include: segmenting the backlight statistical value of each backlight area to obtain the set backlight value of each backlight area according to a set backlight value calculation formula, The set backlight value calculation formula is:

$$BL_{set} = \begin{cases} 240 & BL_{st\ a} \geq 240 \\ \left[\frac{BL_{st\ a}}{16}\right]_{floor} * 16 & 240 > BL_{st\ a} > 16 \\ 16 & 1 < BL_{st\ a} \leq 16 \\ 0 & BL_{st\ a} = 0 \end{cases};$$

wherein, $BL_{set}$ represents the set backlight value; $BL_{sta}$ represents the backlight statistical value; $[\ ]_{floor}$ represents a rounding down operation, and "*" in the set backlight value calculation formula represents a multiplication operation.

Optionally, in step S102, determining the equivalent backlight luminance of each pixel point according to the backlight source diffusion transmission parameter of the backlight module of the display device and the set backlight value of each backlight area may include:

X1, determining diffusion weights of A*B effective backlight sources that affect a luminance of the pixel point to the pixel point according to the backlight source diffusion transmission parameters, wherein A and B are positive integers;

X2, determining target diffusion weights of the A*B effective backlight sources to the pixel point according to the determined diffusion weights of the A*B effective backlight sources to the pixel point; and X3, determining a total diffusion luminance of the A*B effective backlight sources at the pixel point according to the target diffusion weights of the A*B effective backlight sources to the pixel point and the set backlight value of each backlight area, and taking the total diffusion luminance as the equivalent backlight luminance of the pixel point.

Optionally, in above step X1, in a first possible implementation, the backlight source diffusion transmission parameter may be a point spread function y=f(x) that characterizes a relationship between a diffusion luminance y and a diffusion distance x, and the diffusion weights of A*B effective backlight sources that affect the luminance of the pixel point to the pixel point can be determined by calling the point spread function. In a second possible implementation, the backlight source diffusion transmission parameter may be the diffusion weights of A*B effective backlight sources to the pixel point, and the diffusion weights of A*B effective backlight sources to the pixel point can be directly obtained by calling the backlight source diffusion transmission parameters. Descriptions are given as follows by taking these two implementations as examples.

In the first possible implementation, determining the diffusion weights of A*B effective backlight sources that affect the luminance of the pixel point to the pixel point according to the backlight source diffusion transmission parameter includes: calling the backlight source diffusion transmission parameter of the backlight module of the display device, wherein the backlight source diffusion transmission parameter is a point spread function y=f(x) that characterizes the relationship between the diffusion luminance y and the diffusion distance x; determining the A*B effective backlight sources that affect the luminance of the pixel point according to the point spread function y=f(x); and determining the diffusion weights of the A*B effective backlight sources to the pixel point according to distances from the pixel point to the A*B effective backlight sources through the point spread function.

In this possible implementation, in order to obtain the backlight source diffusion transmission parameters, the method further includes:

obtaining illumination diffusion data of each backlight source of a plurality of backlight sources from different backlight areas of the display device, wherein the illumination diffusion data of each backlight source includes: luminance data of a plurality of pixel points on the screen of the display device and distance data representing a distance from a position of each pixel point to a position of a turned-on backlight source when each backlight source is turned on individually; setting a luminance of a pixel point as a diffusion luminance y, setting a distance between a position of the pixel point and a backlight source as a diffusion distance x, and establishing a point spread function y=f(x) that characterizes the relationship between the diffusion luminance y and the diffusion distance x; performing fitting to the point spread function according to the data corresponding to each pixel point to obtain various parameters in the point spread function, and taking the point spread function as the backlight source diffusion transmission parameter.

Wherein, when each backlight source is turned on individually, the luminance data of the plurality of pixel points on the screen of the display device may include: luminance data of a plurality of pixel points at a plurality of different distances to the position of the turned-on backlight source in the horizontal direction and the vertical direction of the position of the turned-on backlight source. The distance data representing the distance from the position of each pixel point to the position of the backlight source includes: distance data representing distances from a plurality of pixel points at a plurality of different distances to the turned-on backlight source in the horizontal direction and the vertical direction of the position of the turned-on backlight source. Here, the horizontal direction is the row direction of the screen of the display device, and the vertical direction is the column direction of the screen of the display device.

Optionally, performing fitting to the point spread function according to the data corresponding to each pixel point to obtain various parameters in the point spread function may include:

removing data corresponding to the pixel points whose luminance is less than a first luminance threshold from the illumination diffusion data, and taking the pixel points whose luminance is greater than or equal to the first luminance threshold as the effective pixel points, to obtain the data corresponding to the effective pixel points; and performing fitting to the point spread function according to the data corresponding to each effective pixel point to obtain various parameters in the point spread function.

Optionally, performing fitting to the point spread function according to the data corresponding to each effective pixel point to obtain various parameters in the point spread function may include:

performing statistical analysis on the data corresponding to each effective pixel point to obtain an average value of the diffusion luminance corresponding to each diffusion distance as an average diffusion luminance of each diffusion distance; and performing curve fitting according to each diffusion distance and the average diffusion luminance of each diffusion distance to obtain the various parameters in the point spread function.

Exemplarily, the point spread function y=f(x) is a piecewise polynomial function:

$$f(x)=\begin{cases}\sum_{n=0}^{k} a_n x^n & 0 \le x \le d1 \\ \sum_{n=0}^{k} b_n x^n & d1 < x \le d2\end{cases},$$

wherein, k is a polynomial order, $a_n$ and $b_n$ are coefficients, d1 is a decomposition distance of the piecewise polynomial function, d2 is a maximum diffusion distance, which is a distance between a backlight source and an effective pixel point farthest from the backlight source, x is a diffusion distance, and y is a diffusion luminance. Exemplarily, the decomposition distance d1 can be determined according to the division form of the backlight areas of the display device.

Additionally, the maximum diffusion distance d2 in the above piecewise polynomial function may also be the distance between a backlight source and a pixel point farthest from the backlight source.

In the second possible implementation, determining the diffusion weights of A*B effective backlight sources that affect the luminance of the pixel point to the pixel point according to the backlight source diffusion transmission parameter includes: calling the backlight source diffusion transmission parameter of the backlight module of the display device, wherein the backlight source diffusion transmission parameter is the diffusion weights of the A*B effective backlight sources to the pixel point; and determining the diffusion weights of A*B effective backlight sources that affect the luminance of the pixel point to the pixel point according to the called backlight source diffusion transmission parameters.

In this possible implementation, in order to obtain the backlight source diffusion transmission parameters, the method further includes:

obtaining illumination diffusion data of each backlight source of a plurality of backlight sources from different backlight areas of the display device, wherein the illumination diffusion data of each backlight source includes: luminance data of a plurality of pixel points on a screen of the display device and distance data representing a distance from a position of each pixel point to a position of a turned-on backlight source when each backlight source is turned on individually; setting the luminance of a pixel point as a diffusion luminance y, setting the distance between a position of the pixel point and a backlight source as a diffusion distance x, and establishing a point spread function y=f(x) that characterizes the relationship between the diffusion luminance y and the diffusion distance x; and performing fitting to the point spread function according to the data corresponding to each pixel point to obtain various parameters in the point spread function; determining the A*B effective backlight sources that affect the luminance of the pixel point according to the point spread function y=f(x); determining the diffusion weights of the A*B effective backlight sources to the pixel point according to distances from the pixel point to the A*B effective backlight sources through the point spread function; and taking the diffusion weights of the A*B effective backlight sources to the pixel point as the backlight source diffusion transmission parameter.

In the above step X2, there may also be multiple ways to determine the target diffusion weights of the A*B effective backlight sources to the pixel point according to the diffusion weights of the A*B effective backlight sources to the pixel point. For example, in the first determining way, the determined diffusion weights of the A*B effective backlight sources to the pixel point may be directly taken as the target diffusion weights of the A*B effective backlight sources to the pixel point. In the second determining way, normalization may be performed on the determined diffusion weights of the A*B effective backlight sources to the pixel point, to obtain the target diffusion weights of the A*B effective backlight sources to the pixel point. The processes of steps X2 and X3 are illustrated here by taking the above two possible implementations as examples.

In the first determining way, in the above step X2, determining the target diffusion weights of the A*B effective backlight sources to the pixel point according to the diffusion weights of the A*B effective backlight sources to the pixel point includes: taking the determined diffusion weights of the A*B effective backlight sources to the pixel point as the target diffusion weights of the A*B effective backlight sources to the pixel point.

Correspondingly, in the above step X3, determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point may include: obtaining the total diffusion luminance of the A*B effective backlight sources at the pixel point according to the target diffusion weights of the A*B effective backlight sources to the pixel point through an equivalent backlight luminance calculation formula, and taking the total diffusion luminance as the equivalent backlight luminance $BL_{equ}$ of the pixel point. The equivalent backlight luminance calculation formula is:

$$BL_{equ}=\sum_{i=1}^{A}\sum_{j=1}^{B} f(x_{i,j})L_{i,j},$$

wherein $x_{i,j}$ represents the distance between the pixel point (i,j) and each effective backlight source, $f(x_{i,j})$ represents the diffusion weight of each effective backlight source to the pixel point(i,j), $L_{i,j}$ represents the luminance reference value of each effective backlight source, the luminance reference value is determined according to set backlight value of the backlight area where the effective backlight source is, and the pixel point(i,j), is any pixel point on the display panel.

In the second determining way, in the above step X2, determining the target diffusion weights of the A*B effective backlight sources to the pixel point according to the determined diffusion weights of the A*B effective backlight sources to the pixel point includes:

performing normalization on the determined diffusion weights of the A*B effective backlight sources to the pixel point according to a normalization calculation formula to obtain a normalized diffusion weight of the A*B effective backlight sources to the pixel point; and taking the normalized diffusion weight of the A*B effective backlight sources to the pixel point as the target diffusion weights of the A*B effective backlight sources to the pixel point.

Correspondingly, in the above step X3, determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point may include: obtaining the total diffusion luminance of the A*B effective backlight sources at the pixel point according to the normalized diffusion weight of the A*B effective backlight sources to the pixel point through an equivalent backlight luminance calculation formula and taking the total diffusion luminance as the equivalent backlight luminance B $L_{equ}$ of the pixel point. The normalization calculation formula is:

$$\text{weight}(i, j) = f(x_{ij})/\text{sum_weight}, \text{sum_weight} = \sum_{i=1}^{A}\sum_{j=1}^{B} f(x_{ij});$$

the equivalent backlight luminance calculation formula is:

$$L_{equ} = \sum_{i=1}^{A}\sum_{j=1}^{B} \text{weight}(i, j)L_{i,j};$$

wherein $x_{i,j}$ represents the distance between the pixel point (i,j) and each effective backlight source, $f(x_{i,j})$ represents the diffusion weight of each effective backlight source to the pixel point(i,j), weight(i,j) represents the normalized diffusion weight of each effective backlight source to the pixel point(i,j), $L_{i,j}$ represents the luminance reference value of each effective backlight source, the luminance reference value is determined according to set backlight value of the backlight area where the effective backlight source is, the pixel point(i,j), is any pixel point on the display panel.

Figure 4:
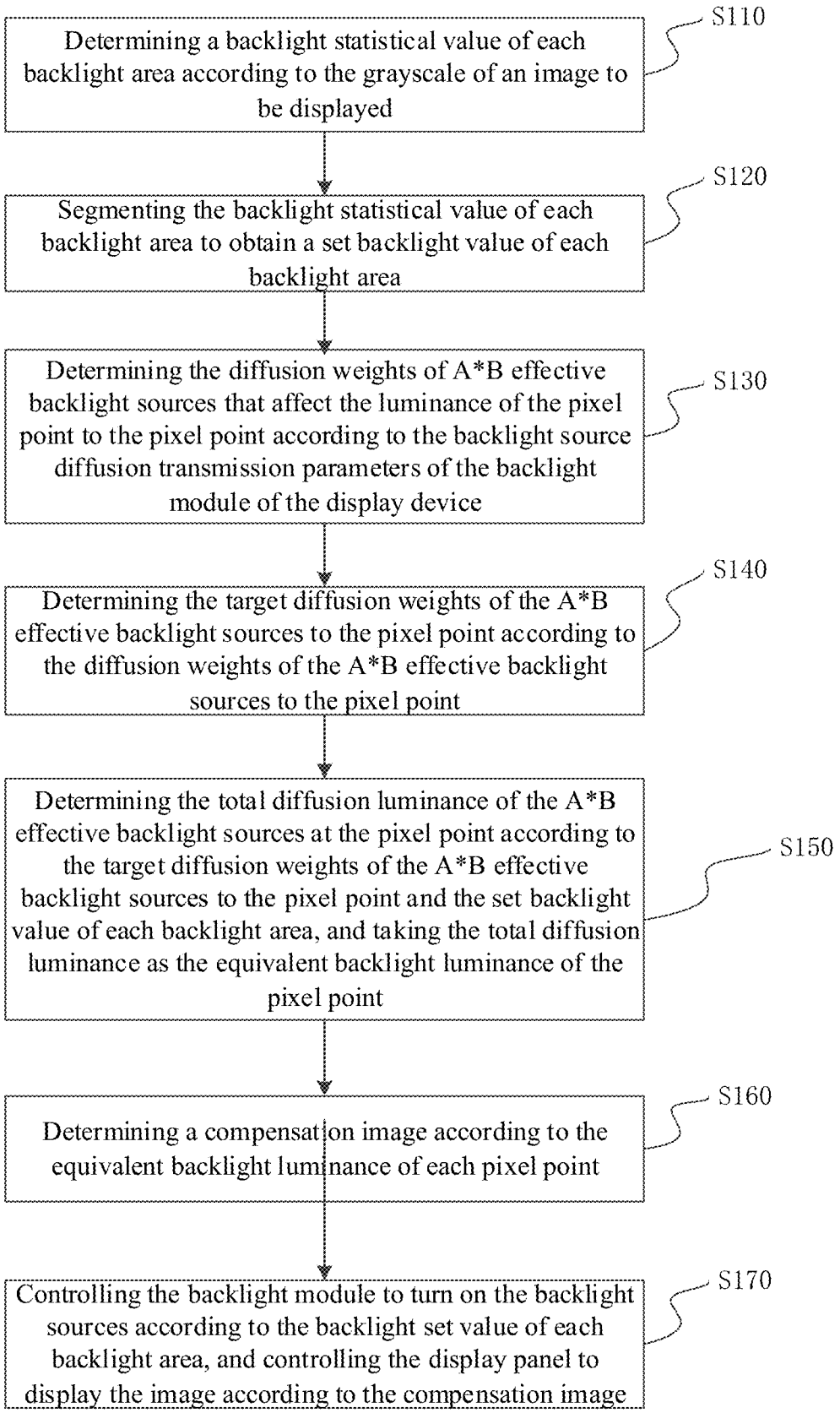
FIG. 4 is a flow chart of another display control method of a backlight source according to an embodiment of the present disclosure.
Figure 5:
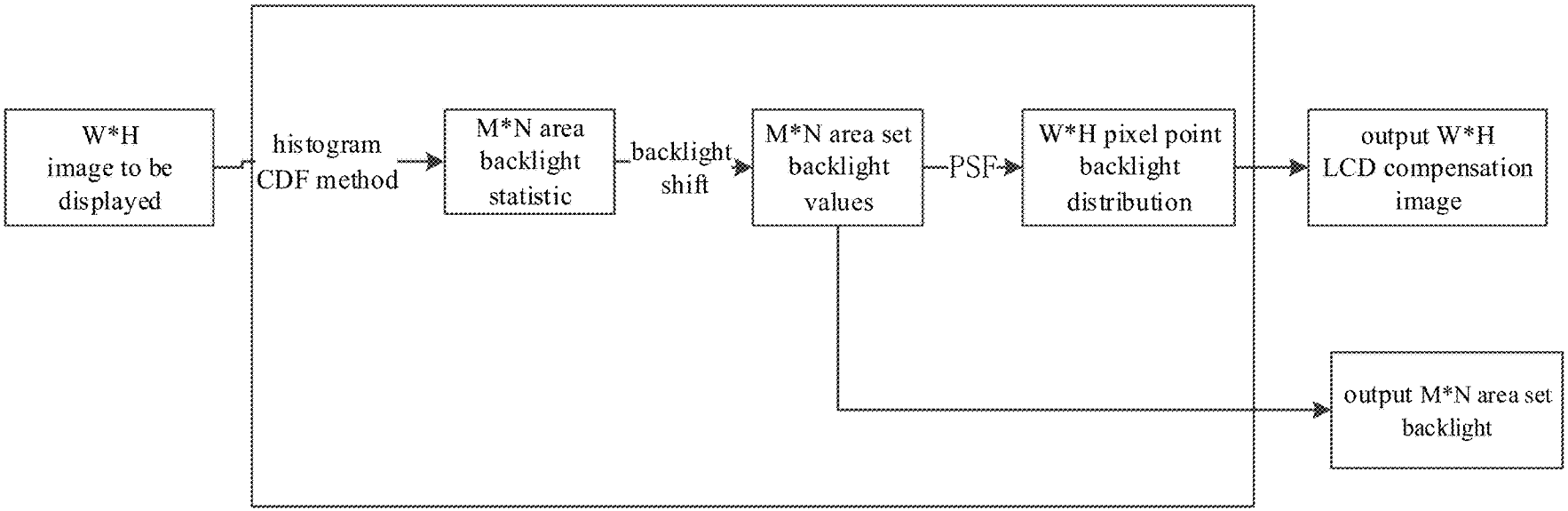
FIG. 5 is a schematic diagram of data flow during a display control process of a backlight source according to an embodiment of the present disclosure.

FIG. 4 is a flow chart of another display control method of a backlight source provided in an embodiment of the present disclosure. The display control method of the backlight source includes steps S110 to S170. FIG. 5 is a diagram of data flow in a display control process corresponding to FIG. 4.

In step S110, a backlight statistical value of each backlight area is determined according to the grayscale of an image to be displayed.

Determining the backlight statistical value of each backlight area according to the grayscale of the image to be displayed may include: determining the backlight statistical value of each backlight area by using a histogram cumulative distribution function (CDF) method. A grayscale mean of pixel points of the image to be displayed within each backlight area is calculated, and is used as the backlight statistical value. Other statistical analysis methods can also be applied to this. For example, the image to be displayed is a W*H (W*H is a pixel resolution) image, and the backlight statistical values of M*N backlight areas are determined according to the histogram CDF method.

In step S120, the backlight statistical value of each backlight area is segmented to obtain a set backlight value of each backlight area.

In step S120, the set backlight values of M*N backlight areas are obtained according to the backlight statistical values of the M*N backlight areas. That is, the set backlight value of each backlight area is obtained according to the backlight statistical value of the corresponding backlight area.

Since the adjustable luminance level of the backlight source is usually less than 256 grayscale levels, when the backlight luminance level is set according to the backlight statistical value, corresponding conversion is needed. For example, the 256 grayscales may be equally divided according to the number of backlight luminance levels, and the grayscale value in each of the equally divided intervals corresponds to one backlight luminance. However, such a simple correspondence cannot fully satisfy the display requirements in practical applications, and situations of compensation truncation and the like may occur.

Accordingly, in some embodiments, a method of determining a set backlight value by means of segmentation is provided. Taking a 4-bit backlight source as an example, the 4-bit backlight source is a backlight source with a luminance level of 4 bits. The 4-bit backlight source can provide 16 levels of adjustable backlight luminance. The set backlight value ranges from 0 to 240 and is an integer multiple of 16, corresponding to 16 backlight luminance levels, respectively. In this case, segmenting the backlight statistical value of each backlight area to obtain the set backlight value of each backlight area includes:

segmenting the backlight statistical value of each backlight area to obtain the set backlight value of each backlight area according to a set backlight value calculation formula. The set backlight value calculation formula is:

$$BL_{set} = \begin{cases} 240 & BL_{st\,a} \geq 240 \\ \left[\frac{BL_{st\,a}}{16}\right]_{floor} * 16 & 240 > BL_{st\,a} > 16 \\ 16 & 1 < BL_{st\,a} \leq 16 \\ 0 & BL_{st\,a} = 0 \end{cases}, \quad (1)$$

wherein, $BL_{set}$ represents the set backlight value, $BL_{sta}$ represents the backlight statistical value, and $[\ ]_{floor}$ represents a rounding down operation. For a backlight area where the backlight statistical value is over 240, the set backlight value is set as 240. For a backlight area where the backlight statistical value ranges from 16 to 240, the set backlight value is set according to an integral multiple of 16, and is rounded down uniformly by adopting a multiple. The set backlight value of the backlight area where the backlight statistical value is less than 16 is raised, and the set backlight value is set as 16. In this way, the compensation value can be prevented from being truncated in the condition of ensuring high contrast.

In step S130, the diffusion weights of A*B effective backlight sources that affect the luminance of the pixel point to the pixel point are determined according to the backlight source diffusion transmission parameters.

Wherein A and B are positive integers.

The backlight source diffusion transmission parameter is used to implement one of the following functions: describing the relationship between the diffusion luminance corresponding to a pixel point and the backlight source luminance of each backlight area, and calculating the relationship between the diffusion luminance corresponding to the pixel point and the backlight luminance of each backlight area.

Figure 6:
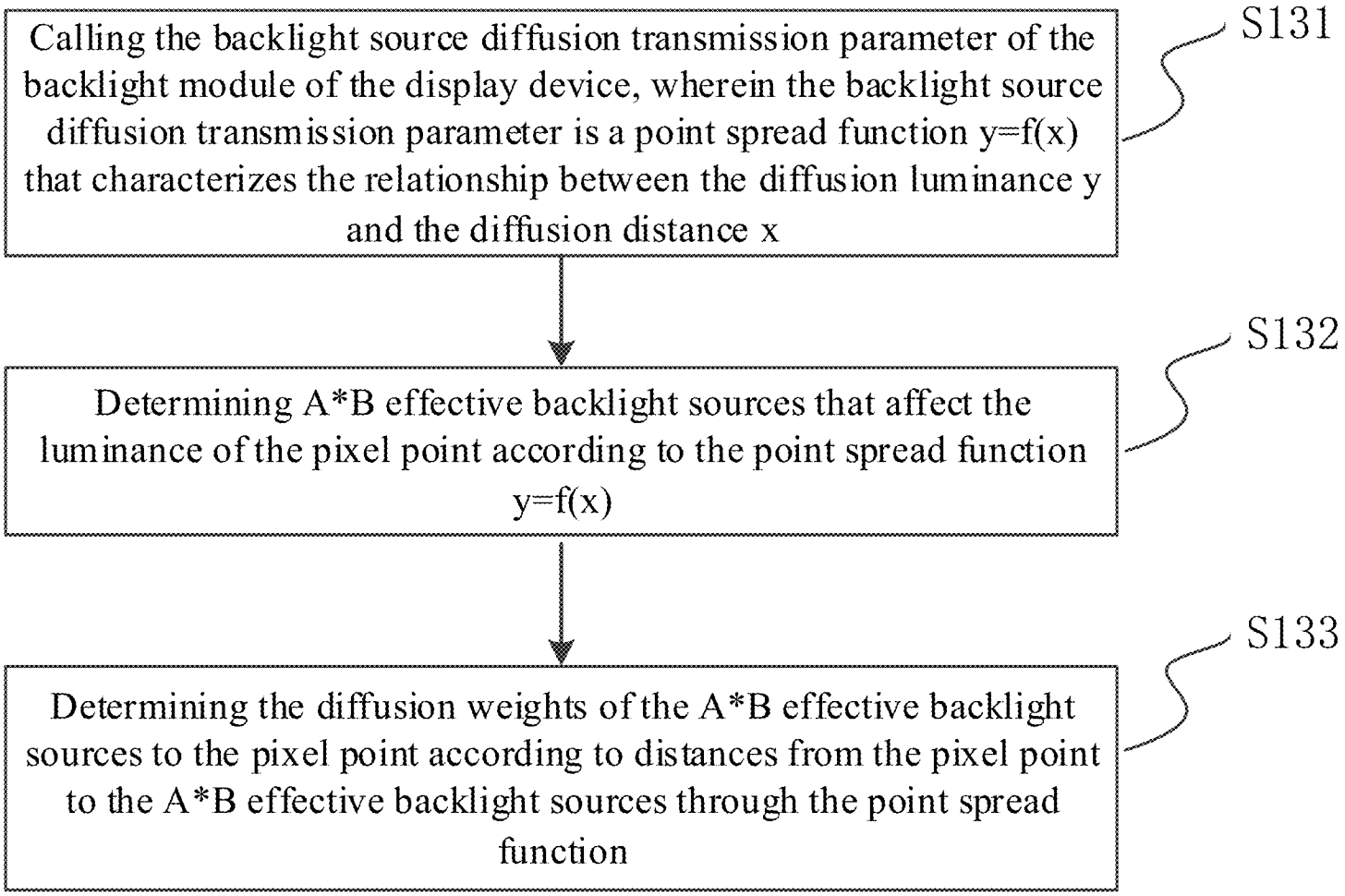
FIG. 6 is a schematic diagram illustrating a flow of determining diffusion weights of effective backlight sources that affect a luminance of a pixel point to the pixel point according to an embodiment of the present disclosure.

FIG. 6 is a schematic diagram of a flow of determining the diffusion weights of A*B effective backlight sources that affect the luminance of the pixel point to the pixel point according to the backlight source diffusion transmission parameter of the backlight module of the display device. The process includes steps S131 to S133.

In step S131, the backlight source diffusion transmission parameter of the backlight module of the display device is called, wherein the backlight source diffusion transmission parameter is a point spread function y=f(x) that characterizes the relationship between the diffusion luminance y and the diffusion distance x.

In step S132, A*B effective backlight sources that affect the luminance of the pixel point are determined according to the point spread function y=f(x).

Exemplarily, all of A*B effective backlight sources that affect the luminance of the pixel point may be determined according to the point spread function y=f(x). According to the effective range of the point spread function, the effective backlight sources of each pixel point may be obtained by reverse derivation. For example, the pixel center may be determined according to the diffusion radius of r, and all backlight sources within the diffusion range of a radius of r are taken as the effective backlight sources.

In step S133, the diffusion weights of the A*B effective backlight sources to the pixel point are determined according to distances from the pixel point to the A*B effective backlight sources through the point spread function.

Here, for each pixel point, the diffusion luminance of the backlight source at the pixel point can be obtained with the following method:

calling the backlight source diffusion transmission parameter of the backlight module of the display device, for example, obtaining the point spread function;

determining all of the effective backlight sources that affect the luminance of the pixel point according to the point spread function;

determining the diffusion distance of each effective backlight source to the pixel point; and obtaining the diffusion luminance of each backlight source at the pixel point according to the distance from each backlight source to the pixel point and the point spread function. Afterwards, the diffusion weights are obtained according to the diffusion luminance.

Figure 7:
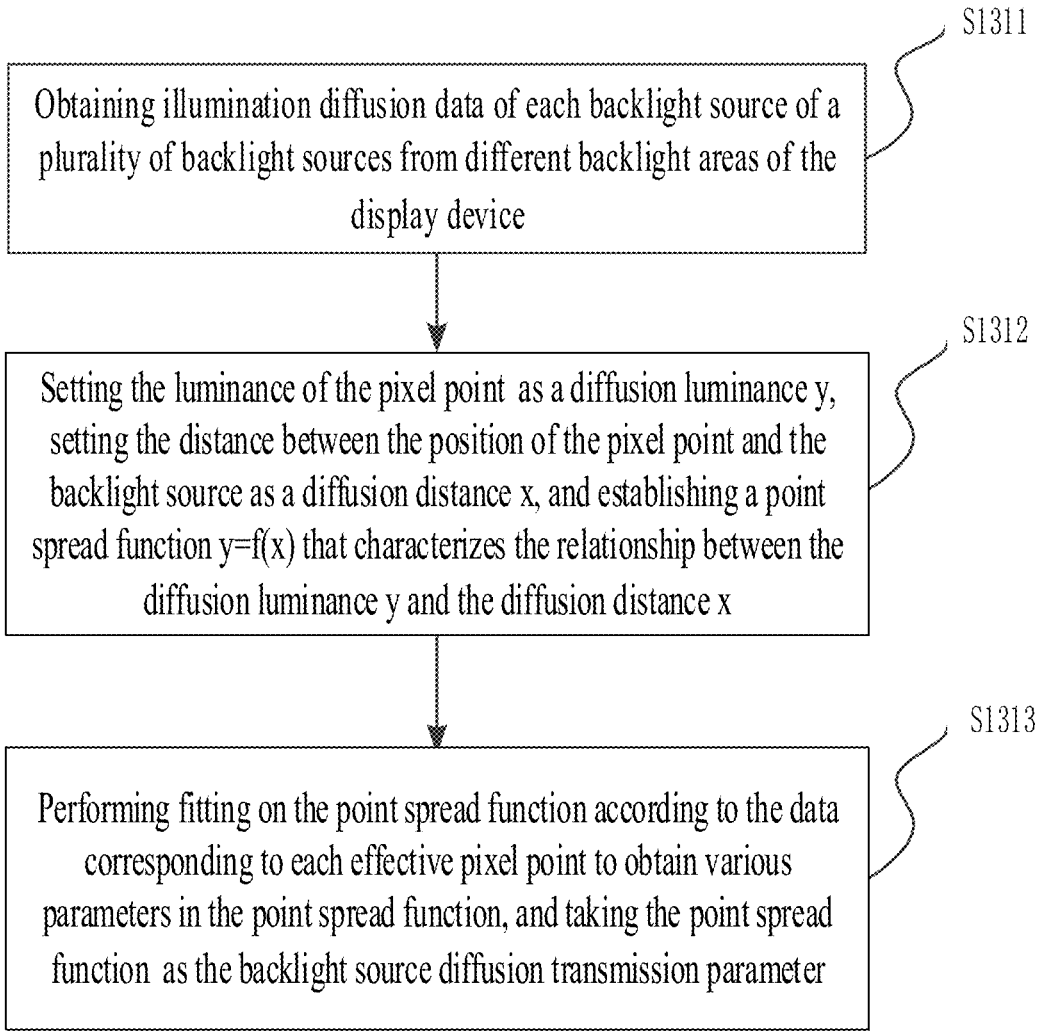
FIG. 7 is a schematic diagram illustrating a flow of obtaining backlight source diffusion transmission parameter according to an embodiment of the present disclosure.

FIG. 7 is a schematic diagram of a flow of obtaining the backlight source diffusion transmission parameter applied to the method shown in FIG. 6. The process includes steps S1311 to S1313.

In step S1311, illumination diffusion data of each backlight source of a plurality of backlight sources from different backlight areas of the display device is obtained.

A plurality of backlight sources are selected from different backlight areas of the display device, and the illumination diffusion data of each backlight source is measured respectively, wherein the illumination diffusion data of each backlight source includes: luminance data of a plurality of pixel points on the screen of the display device and distance data representing a distance from the position of each pixel point to the position of the turned-on backlight source when each backlight source is turned on individually.

Here, the position of the pixel point may be described by a pixel point coordinate position of the pixel point on the screen of the display device, and the position of backlight source may be described by a pixel coordinate position of the pixel point, which corresponds to the center of the backlight source, on the screen of the display device. The pixel point on the screen of the display device is also the pixel point at the orthographic projection of the center of the backlight source on the screen of the display device.

Figure 8:
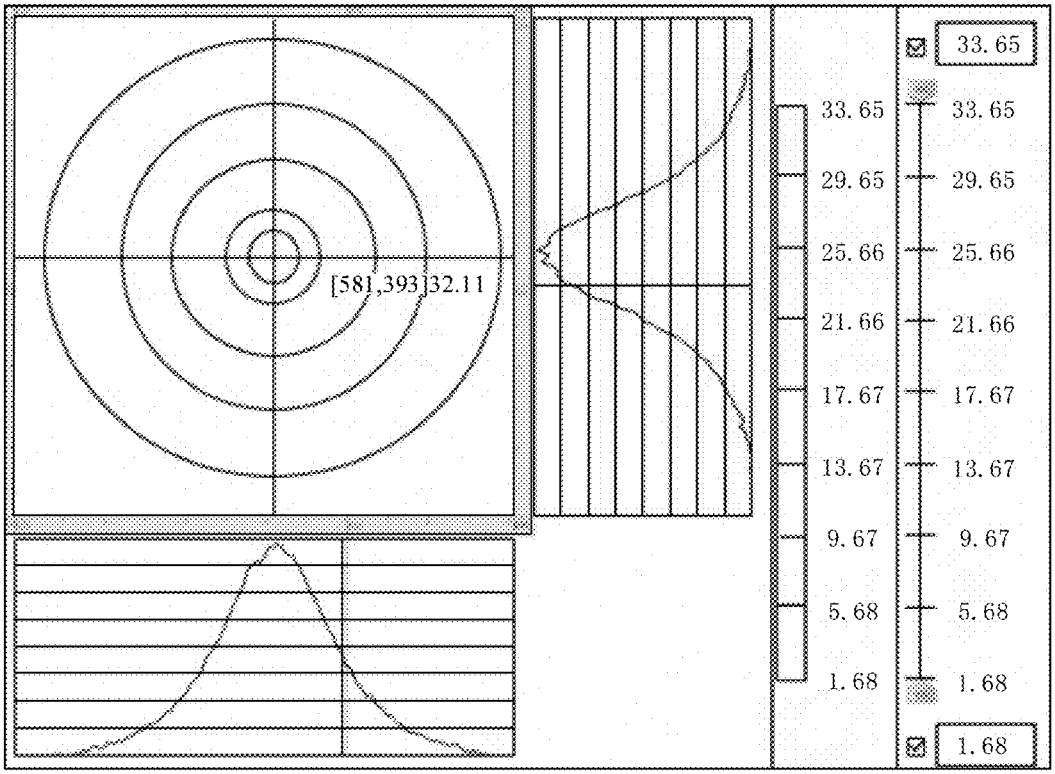
FIG. 8 is a schematic diagram of a software interface of a brightness acquiring apparatus for acquiring luminance data according to an embodiment of the present disclosure.

Exemplarily, the luminance of the pixel point can be measured by using various existing luminance measurement apparatuses, for example, a two-dimensional color analyzer CA2000. For example, FIG. 8 is a schematic diagram of a software interface of the two-dimensional color analyzer CA2000 for acquiring luminance data according to an embodiment of the present disclosure. By photographing the screen of the display device, the maximum diffusion distance and the diffusion intensity of the luminance of the backlight source in one backlight area can be obtained according to the photographing result (the diffusion intensity is used to indicate the degree of change of the diffusion luminance with change of the diffusion distance). During the measurement of the illumination diffusion data, all of the display grayscales of the display device may be set as 255, that is, the equivalence of the backlight control signal controlling a single backlight source to be turned on, and the LCD compensation image signal controlling the display panel to display all images with a grayscale of 255. Under this state, the measurement of the illumination diffusion of the backlight source is presented with the final luminance on the screen, so that the structure of the display device, the properties of the light guide plate/film and the like are all included in the established model, and are finally reflected by the backlight source diffusion transmission parameters.

In order to make the acquired data better reflect the situation of various positions on the screen of the display device to better reflect the overall situation of the screen of the display device, in some embodiments, the plurality of backlight sources in different backlight areas may include backlight sources in backlight areas in the middle, upper left, upper right, lower left, and lower right of the screen of the display device. For example, five backlight sources in the backlight areas in the above five orientations may be selected for measurement. Obviously, different orientations and different numbers of backlight sources may also be selected. Exemplarily, all the backlight sources in the backlight areas may be turned on and measured one by one. The more the number of backlight sources measured, the more complete the obtained illumination diffusion data can reflect the overall situation on the screen of the display device. Correspondingly, the number of experiments required and the operand of data processing will be increase, and can thus be flexibly selected according to actual needs.

The distance data representing the distance from the position of the pixel point to the position of the backlight source may be described according to the pixel distance from the position of the pixel point to the backlight source. That is, when the distance between the position of the pixel point and the position of the backlight source is measured, the pixel distance between the position of the pixel point and the backlight source may be measured. Therefore, in the case of collecting the illumination diffusion data corresponding to the backlight source, in order to facilitate the calculation of the pixel distance, the pixel point of which the pixel distance to the center of the backlight source is an integer may be selected to collect data. For example, when each backlight source is turned on individually, the luminance data of the plurality of pixel points on the screen of the display device and the distance data representing the distance from the position of each pixel point to the position of the backlight source include: luminance data and distance data representing the distances from a plurality of pixel points at a plurality of different distances to the turned-on backlight source in the horizontal direction and vertical direction of the position of the turned-on backlight source. That is, when each backlight source is turned on individually, the luminance data of a plurality of pixel points on the screen of the display device may include: luminance data of a plurality of pixel points at a plurality of different distances to the turned-on backlight source in the horizontal direction and vertical direction of the position of the turned-on backlight source, and the distance data representing the distance from the position of each pixel point to the position of the backlight source may include: distance data representing the distances from a plurality of pixel points at a plurality of different distances to the turned-on backlight source in the horizontal direction and vertical direction of the position of the turned-on backlight source. Here, the horizontal direction is the row direction of the screen of the display device, and the vertical direction is the column direction of the screen of the display device.

Of course, it is also possible to select pixel points at other positions. For example, each of the pixel points in the horizontal and vertical directions may be selected, or a certain number of pixel points at intervals can be selected.

In step S1312, the luminance of the pixel point is set as a diffusion luminance y, the distance between the position of the pixel point and the backlight source is set as a diffusion distance x, and a point spread function y=f(x) that characterizes the relationship between the diffusion luminance y and the diffusion distance x is established.

Here, the distance between the position of the pixel point and the backlight source is the distance between the position of the pixel point and the position of the backlight source.

The point spread function y=f(x) may be set to a polynomial function according to the optical properties of the backlight source. To prevent the polynomial order from being too high and over-fitting during data fitting, in some embodiments, a point spread function model may be established using a piecewise polynomial.

For example, the point spread function y=f(x) can be set as a piecewise polynomial function:

$$f(x) = \begin{cases} \sum_{n=0}^{k} a_n x^n & 0 \le x \le d1 \\ \sum_{n=0}^{k} b_n x^n & d1 < x \le d2 \end{cases}, \quad (2)$$

wherein, k is a polynomial order, $a_n$ and $b_n$ are coefficients, d1 is a decomposition distance of the piecewise polynomial function, d2 is a maximum diffusion distance, i.e., the distance between the backlight source and an pixel point farthest from the backlight source, x is a diffusion distance, and y is a diffusion luminance.

Exemplarily, the decomposition distance d1 of the piecewise polynomial function may be determined according to the division form of the backlight areas of the display device. For example, an integral multiple of the length of the backlight area in the horizontal direction or the vertical direction may be taken as d1. Alternatively, the radius of the diffusion range may be halved or equally divided into N portions to obtain D1, where N is a positive integer greater than or equal to 2.

Alternatively, a spline function (such as an $N^{th}$ power spline function or a B-spline function) may also be used as a basis function to model the point spread function. The parameter fitting process of the point spread function is similar to that of the polynomial function, and may be implemented by those skilled in the art with reference to the fitting method about the polynomial coefficient in the present disclosure. According to the experimental results, the piecewise polynomial function approaches to the true distribution of the luminance diffusion of the backlight sources among various function forms, and the fitting effect is better.

In step S1313, fitting is performed on the point spread function according to the data corresponding to each effective pixel point to obtain various parameters in the point spread function, and the point spread function is taken as the backlight source diffusion transmission parameter.

In the embodiments of the present disclosure, the obtained point spread function of the backlight source may be taken as the backlight source diffusion transmission parameter. Various parameters in the point spread function include various coefficients, i.e., $a_n$ and $b_n$, in the point spread function.

In the embodiments of the present disclosure, the illumination diffusion data may be preprocessed to obtain data corresponding to effective pixel points.

When the illumination diffusion data is preprocessed, invalid or meaningless data may be removed, thereby reducing the calculation amount and increasing the accuracy of the calculation result. For example, the data corresponding to the effective pixel points may be obtained by removing the data corresponding to the pixel points whose luminance is less than a first luminance threshold from the illumination diffusion data. That is, the data corresponding to the pixel points whose luminance is less than the first luminance threshold is removed from the illumination diffusion data, and the pixel points whose luminance is greater than the first luminance threshold and the pixel points whose luminance is equal to the first luminance threshold are taken as effective pixel points, thereby obtaining the data corresponding to the effective pixel points. As the distance between the position of the pixel point and the position of the backlight source increases, the luminance of the pixel point will decrease. After the luminance of the pixel point decreases to a certain extent, the impact on the overall luminance of the screen of the display device will be minimal. In the embodiment of the present disclosure, in order to reduce the calculation amount, data indicating the luminance decreases to be less than the first luminance threshold may be removed, to obtain a diffusion range of the luminance of a single backlight source. Moreover, the pixel point whose luminance is too low and which is far away from the position of the backlight source has a relatively large error, and the fitting results may be caused to be inaccurate and relatively large errors may occur when the data is used for subsequent function fitting.

Exemplarily, the first luminance threshold may selected to be 3% to 5% of the luminance at the center of the backlight source.

It should be noted that when the illumination diffusion data is preprocessed by adopting the above method, the maximum diffusion distance d2 in the above formula (2) is the distance between the backlight source and the effective pixel point farthest from the backlight source.

Figure 9:
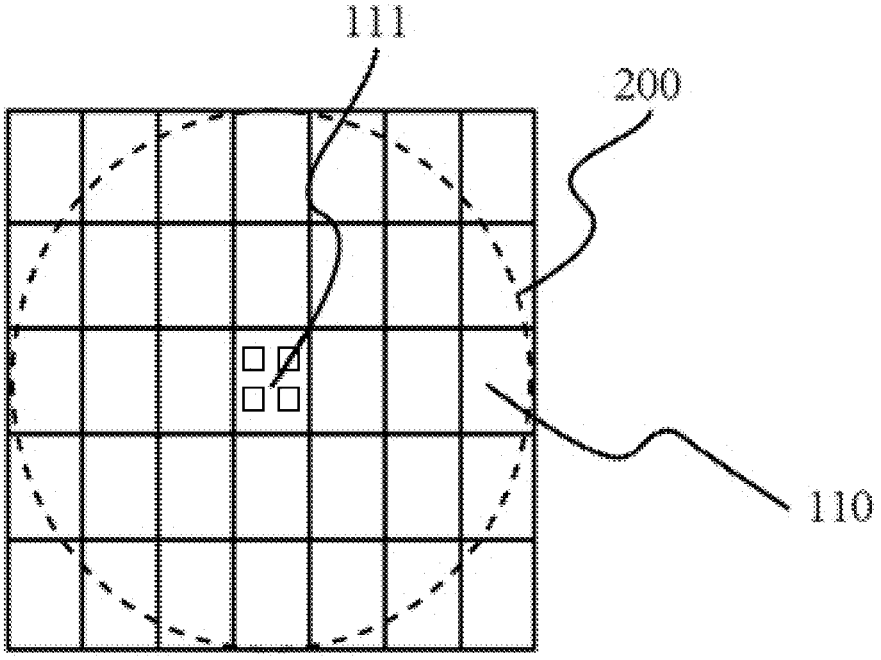
FIG. 9 is a schematic diagram of a diffusion range of a single backlight source according to an embodiment of the present disclosure.

FIG. 9 is a schematic diagram of a diffusion range of the luminance of a single backlight source according to an embodiment of the present disclosure. The diffusion range 200 of the luminance of the backlight source 111 includes seven backlight areas 110 in the horizontal direction and five backlight areas 110 in the vertical direction. Although the backlight transmission is isotropic, that is, the diffusion ranges are the same in all directions. Each backlight area is not square because of the difference in the resolution of each backlight area and the display resolution. Therefore, different numbers of backlight areas may be covered in different directions.

After the illumination diffusion data is preprocessed, fitting is performed on the point spread function according to the data corresponding to each effective pixel point to obtain various parameters in the point spread function.

Here, in order to obtain more accurate results, performing fitting on the point spread function according to the data corresponding to each effective pixel point to obtain various parameters in the point spread function includes: performing statistical analysis on data corresponding to each effective pixel point to obtain an average value of the diffusion luminance corresponding to each diffusion distance as the average diffusion luminance of each diffusion distance; and performing curve fitting according to the relationship between each diffusion distance and the average diffusion luminance of each diffusion distance to obtain various parameters in the point spread function.

In an embodiment, backlight sources in backlight areas of five orientations (i.e., middle, upper left, upper right, lower left, and lower right orientations) may be taken. For each backlight source, the data of the change of luminance in the horizontal and vertical directions with the distance is collected, and a total of 10 sets of illumination diffusion data may be obtained. In theory, the luminance diffusion of the backlight source is generally isotropic in all directions. Upon analysis of the experimental data, the analysis results also show that the relationship of the change of the luminance with the distance in the horizontal and vertical directions is basically the same. Therefore, five sets of illumination diffusion data in one direction may be selected from the 10 sets of illumination diffusion data as the five sets of illumination diffusion data for analysis. In order to eliminate a random error, the average diffusion luminance corresponding to each diffusion distance represented by a pixel may be obtained by averaging the five sets of illumination diffusion data for analysis, and the average diffusion luminance corresponding to the obtained diffusion distance is used as the data to be fitted. Then, the corresponding point spread function may be obtained by performing curve fitting of $y=f(x)$ according to the data to be fitted. Although light is diffused smoothly in theory, the display device and external light will cause some interference to the measured data during the measurement process, and the data will have certain fluctuation. Therefore, in the course of curve fitting, some mature algorithms may be used for curve fitting, or tool software may be directly used for data processing. For example, tool fitting may be achieved by using tool software, such as matlab, mathematica, etc., to obtain the corresponding point spread function.

Figure 10:
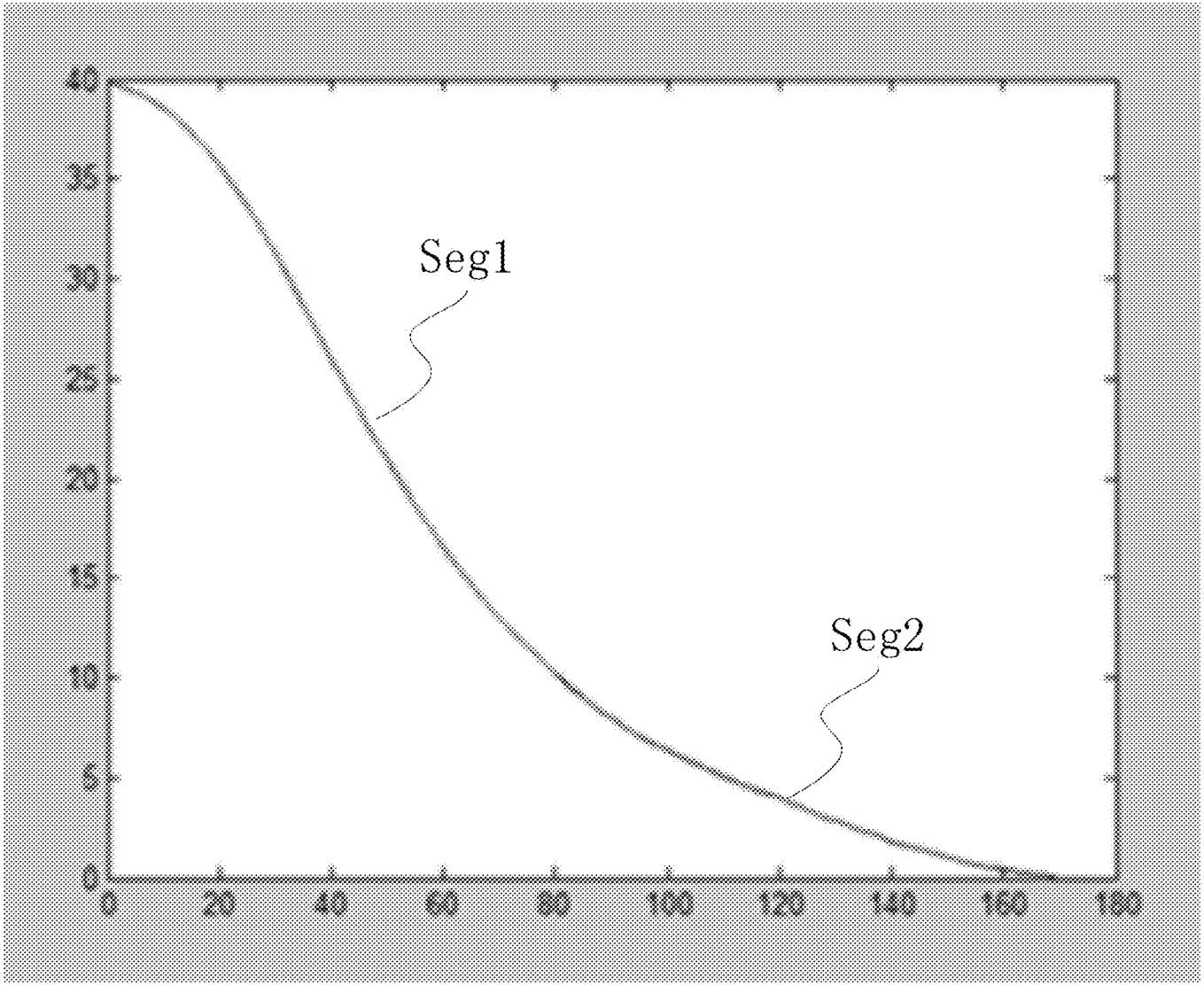
FIG. 10 is a schematic diagram showing a result of curve fitting of a point spread function according to an embodiment of the present disclosure.

FIG. 10 is a schematic diagram showing a result of curve fitting of the point spread function according to an embodiment of the present disclosure. The ordinate is a unit luminance, and the abscissa is a pixel distance (that is, the pixel distance between the position of the pixel point and the backlight source). FIG. 10 shows a schematic diagram of a curve fitted by using matlab software. FIG. 10 shows the fitting results of two segments (Seg1 and Seg2) obtained by performing PSF function fitting according to the piecewise polynomial. Seg1 is a curve when the diffusion distance x falls within [0, d1], and Seg2 is a curve when the diffusion distance x falls within (d1, d2]. As can be seen from FIG. 10, the segments Seg1 and Seg2 achieve a good fitting effect.

By using the method for acquiring the backlight source diffusion transmission parameter provided by the present disclosure, the backlight diffusion may be accurately modeled, thereby facilitating obtaining the situation of luminance diffusion of the backlight source to the pixel point at any distance, and facilitating accurately calculating the equivalent backlight luminance of each pixel point during the local dimming display process. Further, a corresponding LCD compensation image is obtained, and the display effect same as or even better than the full-backlight display is achieved.

Figure 11:
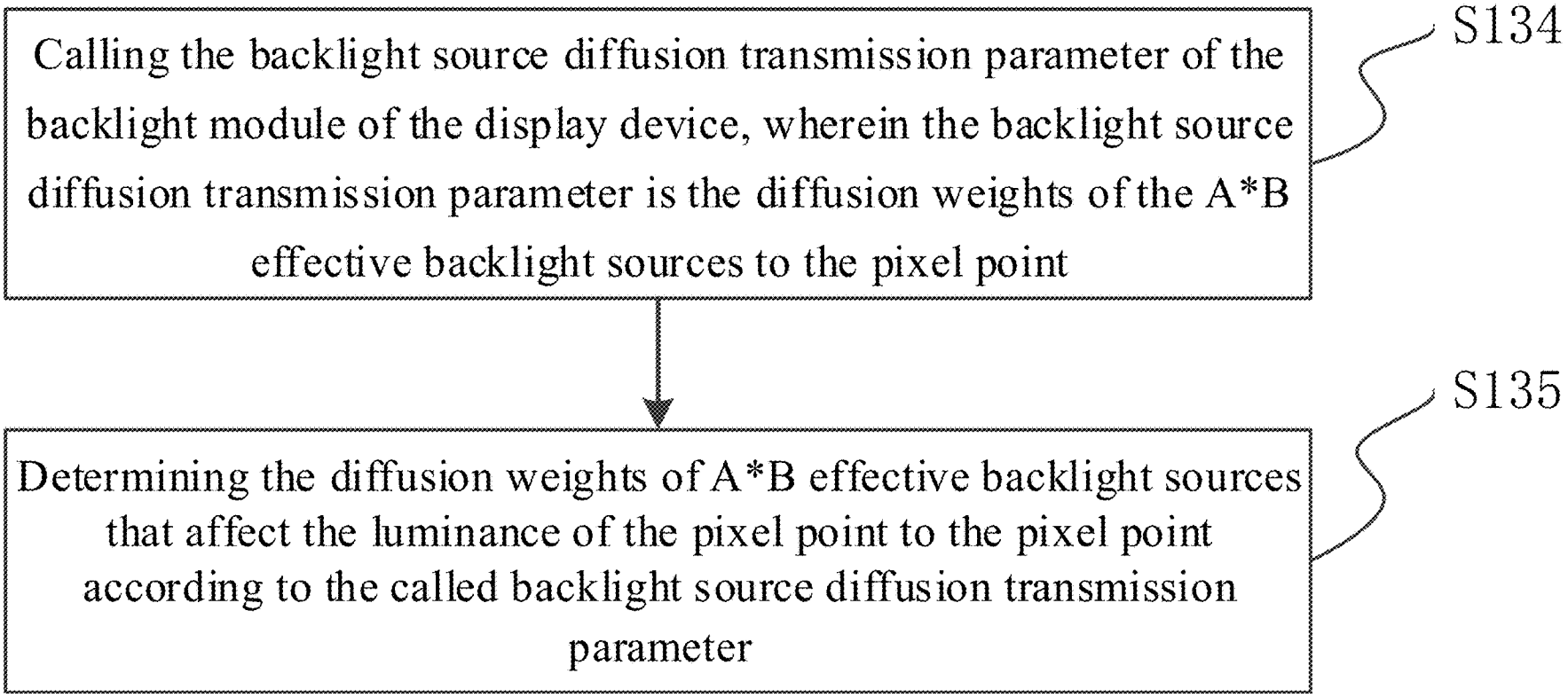
FIG. 11 is a schematic diagram illustrating another flow of determining diffusion weights of effective backlight sources that affect a luminance of a pixel point to the pixel point according to an embodiment of the present disclosure.

FIG. 11 is a schematic diagram illustrating another flow of determining diffusion weights of A*B effective backlight sources that affect a luminance of a pixel point to the pixel point according to an embodiment of the present disclosure. The process includes steps S134 to S135.

In step S134, the backlight source diffusion transmission parameter of the backlight module of the display device is called, wherein the backlight source diffusion transmission parameter i the diffusion weights of the A*B effective backlight sources to the pixel point.

In step S135, the diffusion weights of A*B effective backlight sources that affect the luminance of the pixel point to the pixel point are determined according to the called backlight source diffusion transmission parameter.

Figure 12:
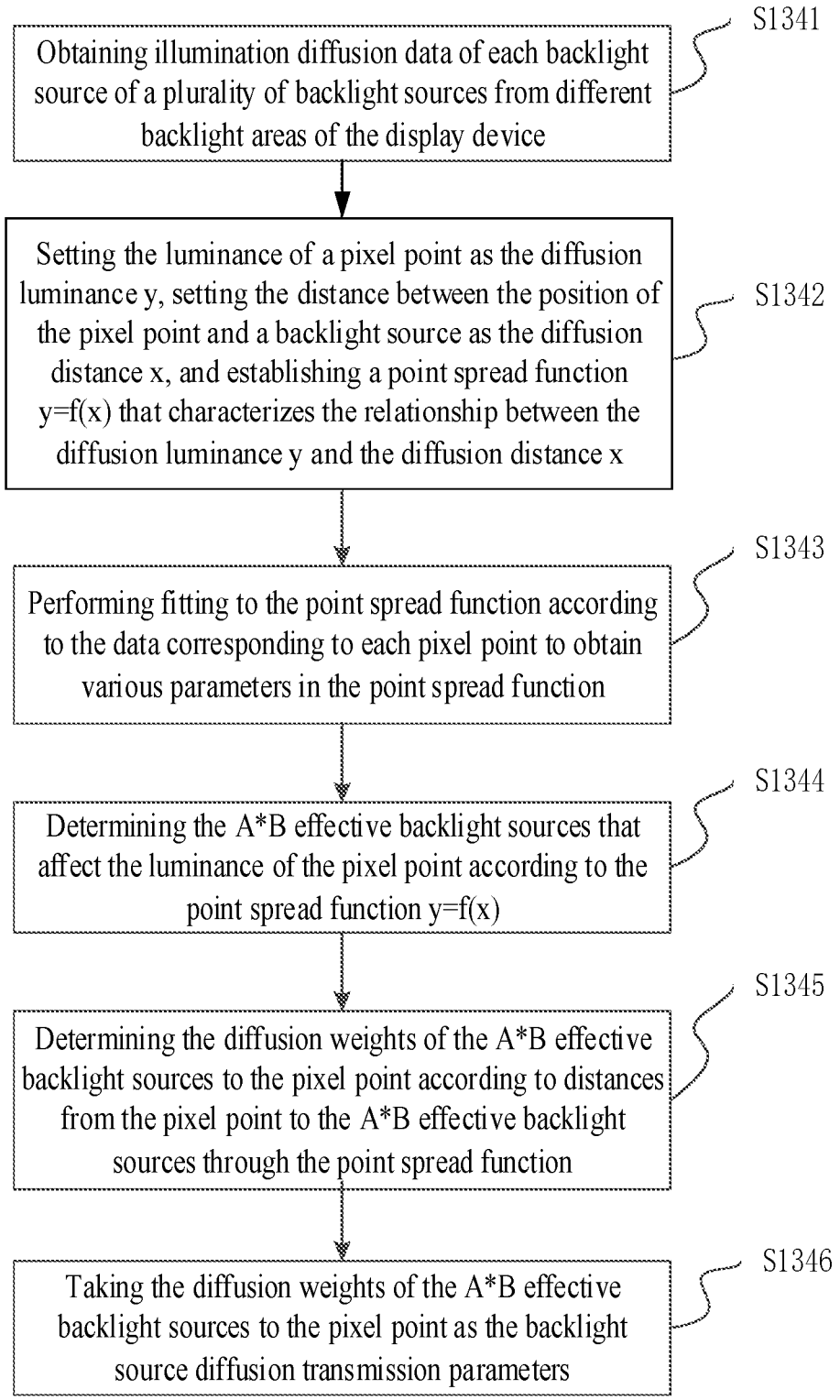
FIG. 12 is a flow chart of yet another display control method of a backlight source according to an embodiment of the present disclosure.

FIG. 12 is a flow chart of determining the backlight source diffusion transmission parameter in the method shown in FIG. 11. The process includes steps S1341 to S1346.

In step S1341, illumination diffusion data of each backlight source of a plurality of backlight sources from different backlight areas of the display device is obtained.

Wherein, the illumination diffusion data of each backlight source includes: luminance data of a plurality of pixel points on the screen of the display device and distance data representing a distance from the position of each pixel point to the position of the turned-on backlight source when each backlight source is turned on individually.

In step S1342, the luminance of a pixel point is set as the diffusion luminance y, the distance between the position of the pixel point and a backlight source is set as the diffusion distance x, and a point spread function $y=f(x)$ that characterizes the relationship between the diffusion luminance y and the diffusion distance x is established.

In step S1343, fitting is performed to the point spread function according to the data corresponding to each pixel point to obtain various parameters in the point spread function.

In step S1344, the A*B effective backlight sources that affect the luminance of the pixel point are determined according to the point spread function $y=f(x)$.

In step S1345, the diffusion weights of the A*B effective backlight sources to the pixel point are determined according to distances from the pixel point to the A*B effective backlight sources through the point spread function.

In step S1346, the diffusion weights of the A*B effective backlight sources to the pixel point are taken as the backlight source diffusion transmission parameters.

Here, the processes of steps S1341 to S1346 may be made reference to the processes of the above-mentioned steps S1311 to S1313 and steps S132 to S133, and are not repeated here.

In the embodiments of the present disclosure, the backlight source diffusion transmission parameter may also be the diffusion weights of the A*B effective backlight sources to the pixel point in addition to the point spread function. In the display device, the diffusion weights corresponding to the A*B effective backlight sources can be calculated in real time, and then the equivalent backlight luminance of the pixel point can be determined according to the diffusion weights. Alternatively, the diffusion weights corresponding to the A*B effective backlight sources of each pixel point may be taken as the backlight source diffusion transmission parameters, and the backlight source diffusion transmission parameter is stored, without the need of recalculation each time. During display, the equivalent backlight luminance of the pixel point is determined according to the pre-stored diffusion weights of the effective backlight sources and the set backlight value.

In step S140, the target diffusion weights of the A*B effective backlight sources to the pixel point are determined according to the diffusion weights of the A*B effective backlight sources to the pixel point.

In step S150, the total diffusion luminance of the A*B effective backlight sources at the pixel point is determined according to the target diffusion weights of the A*B effective backlight sources to the pixel point and the set backlight value of each backlight area, and the total diffusion luminance is taken as the equivalent backlight luminance of the pixel point.

In a possible implementation, in step S140, determining the target diffusion weights of the A*B effective backlight sources to the pixel point according to the diffusion weights of the A*B effective backlight sources to the pixel point may include: taking the diffusion weights of the A*B effective backlight sources to the pixel point as the target diffusion weights of the A*B effective backlight sources to the pixel point.

In this possible implementation, in step S150, determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point may include:

obtaining the total diffusion luminance of the A*B effective backlight sources at the pixel point according to the target diffusion weights of the A*B effective backlight sources to the pixel point through an equivalent backlight luminance calculation formula, and taking the total diffusion luminance as the equivalent backlight luminance $BL_{equ}$ of the pixel point, wherein the equivalent backlight luminance calculation formula is:

$$L_{equ} = \sum_{i=1}^{A} \sum_{j=1}^{B} f(x_{i,j}) L_{i,j},$$

wherein $x_{i,j}$ represents the distance between the pixel point (i,j) and each effective backlight source, $f(x_{i,j})$ represents the diffusion weight of each effective backlight source to the pixel point(i,j), $L_{i,j}$ represents the luminance reference value of each effective backlight source. The luminance reference value is a dimensionless ratio indicating a relative luminance of the backlight. For example, a ratio of the luminance of a backlight source to the luminance of the backlight source which is turned on at a maximum luminance may be used as the luminance reference value of the backlight source. The luminance reference value may be determined according to the set backlight value of the backlight source during dynamic dimming, and the pixel point (i,j) is any pixel point on the display panel.

Here, in order to simplify the calculation, in the present embodiment, it is assumed that when the backlight sources are different in luminance, the form of the point spread function of each backlight source is constant. That is, for different luminance reference values $L_{i,j}$ of the backlight source, the diffusion weight $f(x_{i,j})$ of the backlight source is only related to the distance $x_{i,j}$, and is independent of the value of the luminance reference value $L_{i,j}$.

In another possible implementation, normalization may further be performed on the determined diffusion weights of the A*B effective backlight sources to the pixel point. In step S140, determining the target diffusion weights of the A*B effective backlight sources to the pixel point according to the diffusion weights of the A*B effective backlight sources to the pixel point may include:

performing normalization on the determined diffusion weights of the A*B effective backlight sources to the pixel point according to a normalization calculation formula to obtain a normalized diffusion weight of the A*B effective backlight sources to the pixel point;

taking the normalized diffusion weight of the A*B effective backlight sources to the pixel point as the target diffusion weights of the A*B effective backlight sources to the pixel point. Wherein, the normalization calculation formula is:

$$\text{weight}(i, j) = f(x_{ij}) / \text{sum_weight}; \ \text{sum_weight} = \sum_{i=1}^{A} \sum_{j=1}^{B} f(x_{ij}),$$

wherein, $x_{i,j}$ represents the distance between the pixel point (i,j) and each effective backlight source, $f(x_{i,j})$ represents the diffusion weight of each effective backlight source to the pixel point (i,j), weight(i,j) represents the normalized diffusion weight of each effective backlight source to the pixel point, and the pixel point(i,j) is any pixel point on the display panel.

In this possible implementation, in step S150, determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point may include:

obtaining the total diffusion luminance of the A*B effective backlight sources at the pixel point according to the normalized diffusion weight of the A*B effective backlight sources to the pixel point through an equivalent backlight luminance calculation formula and taking the total diffusion luminance as the equivalent backlight luminance $BL_{equ}$ of the pixel point. The equivalent backlight luminance calculation formula is:

$$L_{equ} = \sum_{i=1}^{A} \sum_{j=1}^{B} \text{weight}(i, j) L_{i,j} \tag{3}$$

wherein $x_{i,j}$ represents the distance between the pixel point (i,j) and each effective backlight source, weight(i,j) represents the diffusion weight of each effective backlight source to the pixel point (i,j), $L_{i,j}$ represents the luminance reference value of each effective backlight source, the luminance reference value is determined according to set backlight value of the backlight area where the effective backlight source is, and the pixel point (i,j) is any pixel point on the display panel.

In the embodiments of the present disclosure, optionally, after the normalized diffusion weight of the A*B effective backlight sources to the pixel point is obtained, the normalized diffusion weight may be further taken as the backlight source diffusion transmission parameter and stored directly for the calculation of the equivalent backlight luminance, without the calculation of the normalized diffusion weight every time. The equivalent backlight luminance may be calculated through the above equivalent backlight luminance formula (3).

The point spread function of the backlight module may be obtained in advance according to the method of the above embodiment and stored in the display device. For example, the point spread function may be obtained through experiment on each model of display device by the display device manufacturer before delivery from the factory, and stored in a memory of the display device, and called when needed. After the point spread function of the backlight module is obtained, the diffusion weight data corresponding to A*B effective backlight sources for each pixel point is further calculated and stored. Further, the normalized diffusion weight may be calculated and stored. The calculation of the normalized diffusion weight may also be completed in advance, for example by the display device manufacturer before delivery of the product from the factory.

For an easier understanding, operations that can be performed in advance before the dynamic dimming display control are summarized and described. The overall process from measuring the point spread function of the backlight sources to finally obtaining the diffusion weight data is as follows:

(1) data acquisition, i.e., acquiring the illumination diffusion data of a plurality of backlight sources;

(2) data preprocessing, i.e., obtaining a backlight diffusion range and data corresponding to effective pixel points;

(3) point spread function fitting, i.e., performing function fitting according to the data corresponding to the effective pixel points to obtain a point spread function;

(4) calculation of pixel point backlight diffusion weights according to the fitted point spread function, i.e., calculating the diffusion weights of all effective backlight sources of each pixel point;

(5) normalization of the diffusion weights; and (6) acquisition and storage of the final backlight diffusion weights.

In this way, a weight coefficient lookup table may be generated for each backlight source according to a fitting formula. For each pixel point, the backlight diffusion weight may be obtained by retrieving the lookup table as long as the position of the pixel point is determined. In step S140, when the target diffusion weights of the A*B effective backlight sources to the pixel point are determined, the diffusion weights or the normalized diffusion weight of the A*B effective backlight sources to the pixel point may be obtained. In step S150, when the total diffusion luminance of the A*B effective backlight sources at the pixel point is determined, the stored diffusion weights or the normalized diffusion weight of the A*B effective backlight sources to the pixel point are directly called to calculate the equivalent backlight luminance. In this way, the equivalent backlight luminance of each pixel point may be quickly obtained by a simple matrix operation, and therefore the operating speed may be accelerated.

In the local dimming display process, it is necessary to adjust the backlight for each frame of image (or every several frames of images, depending on the design of the control algorithm), respectively. After each adjustment of backlight, the equivalent backlight luminance of each pixel point needs to be recalculated. Therefore, the operating speed is very important. The diffusion weights (or normalized weight diffusion) of the A*B effective backlight sources are stored, and directly called in the display control process, such that the operating speed may be greatly accelerated.

The process of determining the equivalent backlight luminance of each pixel point according to the backlight source diffusion transmission parameter and the set backlight value of each backlight area includes steps S130 to S150. The equivalent backlight luminance of each pixel point is determined according to the backlight source diffusion transmission parameter and the set backlight value of each backlight area, so that the pixel point diffusion backlight distribution of the image having a resolution of W*H may be obtained. The resolution of the image is the same as the resolution of the image to be displayed.

In step S160, a compensation image is determined according to the equivalent backlight luminance of each pixel point.

In step S160, the obtained compensation image is an LCD compensation image. The obtained LCD compensation image is an image having the same resolution of W*H as that of the image to be displayed.

Determining the LCD compensation image according to the equivalent backlight luminance of each pixel point includes: calculating the compensation value $v_{com}$ of each pixel point in the LCD compensation image according to the equivalent backlight luminance of each pixel point through a compensation value calculation formula. The compensation value calculation formula is:

$$v_{com} = 255^{*}\left[\frac{\frac{light_{ideal} * 240}{bl} - light_{min}}{light_{max} - light_{min}}\right]^{1/gamma},$$

wherein, $$light_{ideal} = \left(\frac{v_{ori}}{255}\right)^{gamma} * (light_{max} - l_{en}) + l_{en},$$

in which $light_{ideal}$ represents a target luminance; $v_{ori}$ represents a maximum value among RGB three channels of an image to be displayed; gamma is an index of a relationship curve between the grayscale and the luminance; $light_{max}$ represents a maximum luminance value of an HDR (High-Dynamic Range) system; $l_{en}$ represents an ambient luminance; $light_{max}$ $light_{min}$ represent luminance values when all backlights are turned on and turned off, respectively; and bl represents the equivalent backlight luminance expressed in grayscale. Here, in order to prevent color shift, the above process of determining compensation value $v_{com}$ may be performed in HSV (Hue, Saturation, Value) space. In the HSV space, the above compensation value $v_{com}$ and the maximum value $v_{ori}$ are both lightness values. Exemplarily, the lightness values of the RGB three channels of the image to be displayed are 20, 30 and 40, respectively, and then $v_{com}$ is the maximum lightness value among 20, 30 and 40. That is, $v_{com}$=max(20, 30, 40).

Wherein, in the HDR (High-Dynamic Range) system, the relationship between luminance and grayscale may be expressed as:

$$light_{ideal} = \left(\frac{v_{ori}}{255}\right)^{gamma} * (light_{max} - l_{en}) + l_{en}, \quad (4)$$

wherein, the ambient luminance $l_{en}$ may be 0.002 nit. By using the maximum value $v_{ori}$ in RGB three channels of the image to be displayed to calculate the compensation value, the compensation truncation may be effectively prevented.

In the local dimming system, the relationship between the luminance $light_{ld}$ of a pixel point and the grayscale may be expressed as:

$$light_{id} = \frac{bl}{240}\left[\left(\frac{v_{com}}{255}\right)^{gamma} * (light_{max} - light_{min}) + light_{min}\right], \quad (5)$$

wherein the compensation value of the pixel point is $v_{com}$, bl represents the equivalent backlight luminance expressed in grayscale, which may be determined according to the set backlight value of the backlight area and the backlight source diffusion transmission parameter (for example, bl may be determined according to the normalized weight weight(i,j) and the set backlight value of each backlight area).

The luminance $light_{id}$ of the pixel point and the target luminance $light_{ideal}$ may be made to be same through the operation of image compensation, and may thus be obtained according to formula (4) and formula (5):

$$v_{com} = 255^{*}\left[\frac{\frac{light_{ideal} * 240}{bl} - light_{min}}{light_{max} - light_{min}}\right]^{1/gamma}. \quad (6)$$

In step S170, the backlight module is controlled to turn on the backlight sources according to the backlight set value of each backlight area, and the display panel is controlled to display the image according to the compensation image.

In step S170, the backlight module is controlled to turn on the backlight sources according to the backlight set value of each backlight area, and the display panel is synchronously controlled to display the image according to the compensation image. Wherein, the backlight sources are controlled according to the backlight set values of M*N backlight areas, and the compensation image is an LCD compensation image having a resolution of W*H. As described in step S160, the LCD compensation image may be determined by calculating the compensation value $v_{com}$ of each pixel point in the LCD compensation image.

According to the method of the present disclosure, the processing time of one frame maintains within 4 ms (milliseconds), such that real-time processing of the frame image can be realized, which satisfies the requirements of real-time synchronization, and achieves a good visual effect.

Figure 13:
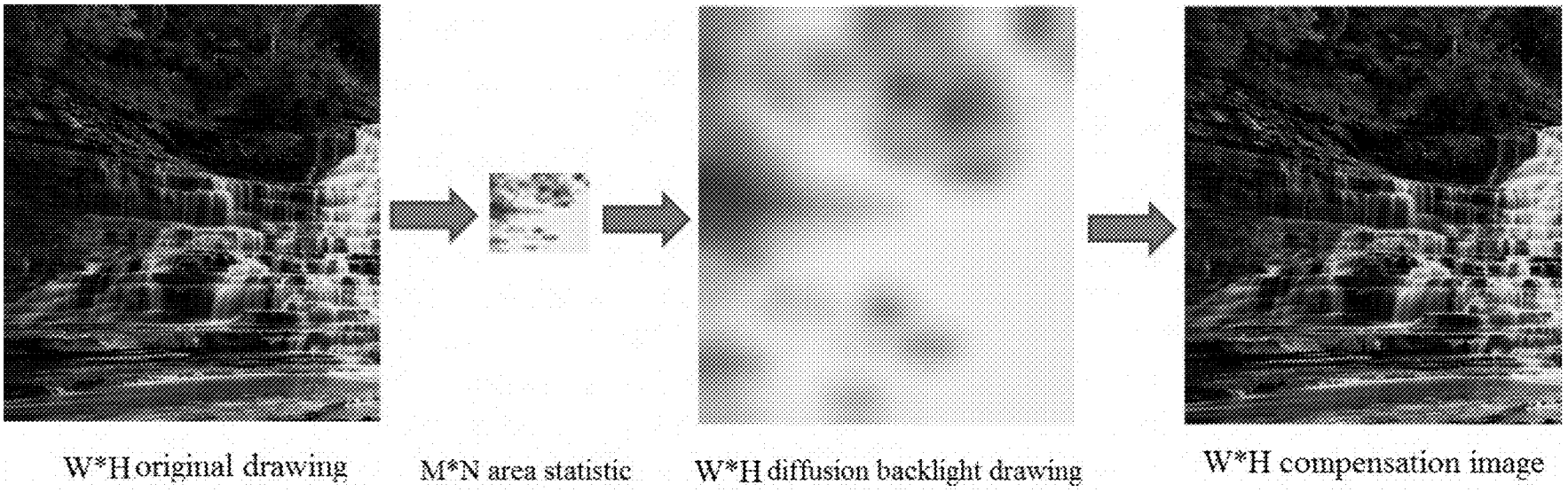
FIG. 13 is an exemplary diagram of image display performed by a display control method of backlight sources according to an embodiment of the present disclosure.

FIG. 13 is an exemplary diagram of image display with the display control method according to an embodiment of the present disclosure. Taking the image to be displayed being an original image having a resolution of W*H as an example, the backlight module has M*N backlight areas. First, the backlight statistical values of the M*N backlight areas are determined to obtain the set backlight values of the respective backlight areas. Then, the backlight display of M*N backlight areas of the backlight module is controlled according to the set backlight values to obtain the equivalent backlight luminance corresponding to each pixel point, thereby forming a diffusion backlight image with a resolution of W*H. Afterwards, the compensation image having a resolution of W*H is calculated according to the diffusion backlight image. It can be seen that, for the area where the backlight is dimmed, the grayscale of the compensation image correspondingly increases, and the luminance is raised.

According to the display control method of the present disclosure, by accurately modeling the backlight diffusion and storing the diffusion weights of the effective backlight sources of each pixel point, the luminance diffusion situation of the backlight source to the pixel point at any distance may be obtained conveniently, which facilitates the calculation of the equivalent backlight luminance of each pixel point accurately and quickly in the local dimming display process. Thus, a smoothly transitional W*H backlight distribution approximating the luminance of the actual backlight diffusion is obtained, thereby obtaining the corresponding LCD compensation image and achieving the same or even better display effect as a full-backlight display. According to the present disclosure, the luminance of the image within a non-low-grayscale range is closer to the actual luminance of the original image, and the image distortion is reduced, accompanied with good image quality, high contrast, low distortion, and no block and boundary lines. In addition, better contrast may also be obtained as a whole due to the reduction in backlight of the relatively dark areas in the image.

Figure 14:
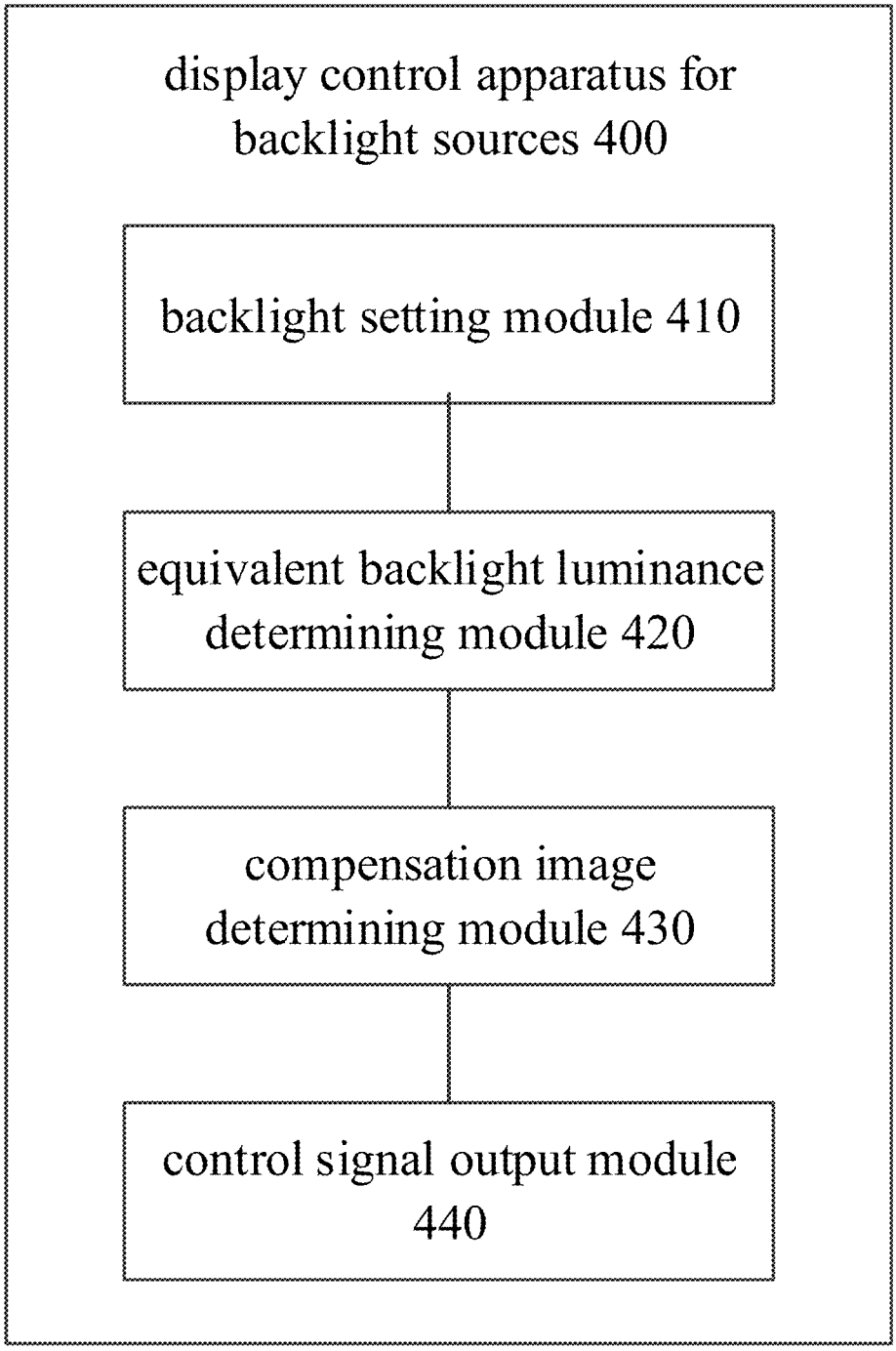
FIG. 14 a block diagram of a structure of a display control apparatus for backlight sources according to an embodiment of the present disclosure.

In order to better implement the method in the above embodiment, an embodiment of the present disclosure further provides a display control apparatus for backlight sources. The apparatus is applied to a display device. The display device includes a display panel and a backlight module. The backlight module includes a plurality of backlight sources and a plurality of backlight areas, each of which is provided with one backlight source. An area, corresponding to each of the backlight areas, on the display panel includes a plurality of pixel points. FIG. 14 is a block diagram of structure of a display control apparatus for backlight sources 400 according to an embodiment of the present disclosure.

The display control apparatus for backlight sources 400 may be applied to a direct-lit type backlight liquid crystal display device including a plurality of adjustable backlight areas. Referring to FIG. 14, the display control apparatus for backlight sources 400 includes: a backlight setting module 410, an equivalent backlight luminance determining module 420, a compensation image determining module 430, and a control signal output module 440.

The backlight setting module 410 is configured to determine the set backlight value of each backlight area according to the grayscale of the image to be displayed.

The equivalent backlight luminance determining module 420 is configured to determine the equivalent backlight luminance of each pixel point according to the backlight source diffusion transmission parameter of the backlight module of the display device and the set backlight value of each backlight area. The backlight source diffusion transmission parameter is used to implement one of the following functions: describing a relationship between the diffusion luminance corresponding to a pixel point and the backlight source luminance of each backlight area, and calculating the relationship between the diffusion luminance corresponding to a pixel point and the backlight source luminance of each backlight area.

Optionally, the backlight setting module 410 is configured to:

determine the backlight statistical value of each backlight area according to the grayscale of the image to be displayed; and segment the backlight statistical value of each backlight area to obtain the set backlight value of each backlight area.

Optionally, the backlight source is a 4-bit backlight source, and the backlight setting module is configured to:

segment the backlight statistical value of each backlight area to obtain the set backlight value of each backlight area according to a set backlight value calculation formula. The set backlight value calculation formula is:

$$BL_{set} = \begin{cases} 240 & BL_{sta} \geq 240 \\ \left[\frac{BL_{sta}}{16}\right]_{floor} * 16 & 240 > BL_{sta} > 16 \\ 16 & 1 < BL_{sta} \leq 16 \\ 0 & BL_{sta} = 0 \end{cases},$$

wherein $BL_{set}$ represents the set backlight value; $BL_{sta}$ represents the backlight statistical value; and $[\ ]_{floor}$ represents a rounding down operation.

Optionally, the equivalent backlight luminance determining module is configured to:

determine diffusion weights of A*B effective backlight sources that affect the luminance of the pixel point to the pixel point according to the backlight source diffusion transmission parameters, wherein A and B are positive integers;

determine the target diffusion weights of the A*B effective backlight sources to the pixel point according to the diffusion weights of the A*B effective backlight sources to the pixel point; and determine the total diffusion luminance of the A*B effective backlight sources at the pixel point according to the target diffusion weights of the A*B effective backlight sources to the pixel point and the set backlight value of each backlight area and take the total diffusion luminance as the equivalent backlight luminance of the pixel point.

Here, determining, by the equivalent backlight luminance determining module, the diffusion weights of A*B effective backlight sources that affect the luminance of the pixel point to the pixel point according to the backlight source diffusion transmission parameter may include multiple possible implementations.

For example, in a possible implementation, the equivalent backlight luminance determining module is configured to:

call the backlight source diffusion transmission parameter of the backlight module of the display device, wherein the backlight source diffusion transmission parameter is a point spread function y=f(x) that characterizes the relationship between a diffusion luminance y and a diffusion distance x;

determine the A*B effective backlight sources that affect the luminance of the pixel point according to the point spread function y=f(x); and determine the diffusion weights of the A*B effective backlight sources to the pixel point according to distances from the pixel point to the A*B effective backlight sources through the point spread function.

For another example, in another possible implementation, the equivalent backlight luminance determining module is configured to:

call the backlight source diffusion transmission parameter of the backlight module of the display device, wherein the backlight source diffusion transmission parameter is the diffusion weights of the A*B effective backlight sources to the pixel point; and determine the diffusion weights of A*B effective backlight sources that affect the luminance of the pixel point to the pixel point according to the called backlight source diffusion transmission parameters.

Determining, by the equivalent backlight luminance determining module, the target diffusion weights of the A*B effective backlight sources to the pixel point according to the diffusion weights of the A*B effective backlight sources to the pixel point may multiple possible implementations.

For example, in a possible implementation, the equivalent backlight luminance determining module is configured to take the determined diffusion weights of the A*B effective backlight sources to the pixel point as the target diffusion weights of the A*B effective backlight sources to the pixel point.

obtain, according to target diffusion weights of the A*B effective backlight sources to the pixel point, the total diffusion luminance of the A*B effective backlight sources at the pixel point through the equivalent backlight luminance calculation formula, and taking the total diffusion luminance as the equivalent backlight luminance $BL_{equ}$ of the pixel point. The equivalent backlight luminance calculation formula is:

$$BL_{equ} = \sum_{i=1}^{A} \sum_{j=1}^{B} f(x_{i,j}) L_{i,j},$$

wherein $x_{i,j}$ represents the distance between the pixel point (i,j) and each effective backlight source, $f(x_{i,j})$ represents the diffusion weight of each effective backlight source to the pixel point (i,j), $L_{i,j}$ represents the luminance reference value of each effective backlight source, and pixel point (i,j) is any pixel point on the display panel.

In another possible implementation, the equivalent backlight luminance determining module is configured to:

perform normalization on the determined diffusion weights of the A*B effective backlight sources to the pixel point according to a normalization calculation formula to obtain a normalized diffusion weight of the A*B effective backlight sources to the pixel point; and take the normalized diffusion weight of the A*B effective backlight sources to the pixel point as the target diffusion weights of the A*B effective backlight sources to the pixel point; and obtain the total diffusion luminance of the A*B effective backlight sources at the pixel point according to the normalized diffusion weight of the A*B effective backlight sources to the pixel point through an equivalent backlight luminance calculation formula and taking the total diffusion luminance as the equivalent backlight luminance $BL_{equ}$ of the pixel point. The normalization calculation formula is:

$$weight(i, j) = f(x_{i,j}) / \text{sum_weight}, \ \text{sum_weight} = \sum_{i=1}^{A} \sum_{j=1}^{B} f(x_{i,j});$$

the equivalent backlight luminance calculation formula is:

$$L_{equ} = \sum_{i=1}^{A} \sum_{j=1}^{B} weight(i, j) L_{i,j};$$

wherein $x_{i,j}$ represents the distance between the pixel point (i,j) and each effective backlight source, $f(x_{i,j})$ represents the diffusion weight of each effective backlight source to the pixel point (i,j), weight(i,j) represents the normalized diffusion weight of each effective backlight source to the pixel point (i,j), $L_{i,j}$ represents the luminance reference value of each effective backlight source, and pixel point (i,j) is any pixel point on the display pane.

In the embodiments of the present disclosure, optionally, after the normalized diffusion weight of the A*B effective backlight sources to the pixel point is determined, the normalized diffusion weight may be further taken as the backlight source diffusion transmission parameter and stored directly for the calculation of the equivalent backlight luminance, without repeating the above calculation process every time.

The compensation image determining module 430 is configured to determine the compensation image according to the equivalent backlight luminance of each pixel point.

Determining, by the compensation image determining module, the compensation image according to the equivalent backlight luminance of each pixel point includes:

calculating the compensation value $v_{com}$ of each pixel point in the compensation image according to the equivalent backlight luminance of each pixel point through a compensation value calculation formula. The compensation value calculation formula is:

$$v_{com} = 255^{*}\left[\frac{\frac{light_{ideal} * 240}{bl} - light_{min}}{light_{max} - light_{min}}\right]^{1/gamma},$$

wherein, $$light_{ideal} = \left(\frac{v_{ori}}{255}\right)^{gamma} * (light_{max} - l_{en}) + l_{en},$$

in which $light_{ideal}$ represents a target luminance; $v_{ori}$ represents a maximum value among RGB three channels of an image to be displayed; gamma is an index of a relationship curve between the grayscale and the luminance; $light_{max}$ represents a maximum luminance value of a high-dynamic range system; $l_{en}$ represents an ambient luminance; $light_{max}$ and $light_{min}$ represent luminance values when all backlights are turned on and turned off, respectively; and bl represents the equivalent backlight luminance expressed in grayscale.

The control signal output module 440 is configured to output control signals for controlling the backlight module to turn on the backlight sources according to the set backlight value of each backlight area, and controlling the display panel to display the image according to the compensation image.

The implementing process of functions and effects of various modules in the display control apparatus of the present disclosure may be made reference to the implementing process of corresponding steps in the display control method for details. For the apparatus embodiments, the foregoing explanation of the method embodiments of the present disclosure is also applicable to the apparatus embodiments of the present disclosure as they substantially correspond to the method embodiments. In order to avoid redundancy, not all of the details are be repeated in the apparatus embodiments. The other related details may be made reference to the related description of the display method embodiments and the backlight source diffusion transmission parameter acquisition method embodiments in the present disclosure with reference to FIG. 1 to FIG. 13.

The present disclosure further provides a display device including a direct-lit backlight module, a display panel, and a display control apparatus for controlling the backlight module and the display panel. Wherein, the display control apparatus is the display control apparatus according to any embodiment of the present disclosure. Exemplarily, the display control apparatus may be as shown in FIG. 14.

Optionally, the display device may be implemented to include a direct-lit backlight module, a display panel, a computer-readable storage medium, and a processor. Wherein, the computer-readable storage medium stores there in executable instructions that, when executed by the processor, implement the above-described display control methods of the present disclosure.

Optionally, the present disclosure further provides a display device, including a direct-lit backlight source, a display panel, a memory and one or more processors. The memory stores therein one or more programs configured to be executed by the one or more processors. The one or more programs include instructions that, when executed by the processor, implement the above display control methods in the present disclosure.

Exemplarily, the display device may be a virtual reality device, such as a VR helmet, VR glasses, or the like. The display device may also be a mobile phone, a wearable device, or the like.

Figure 15:
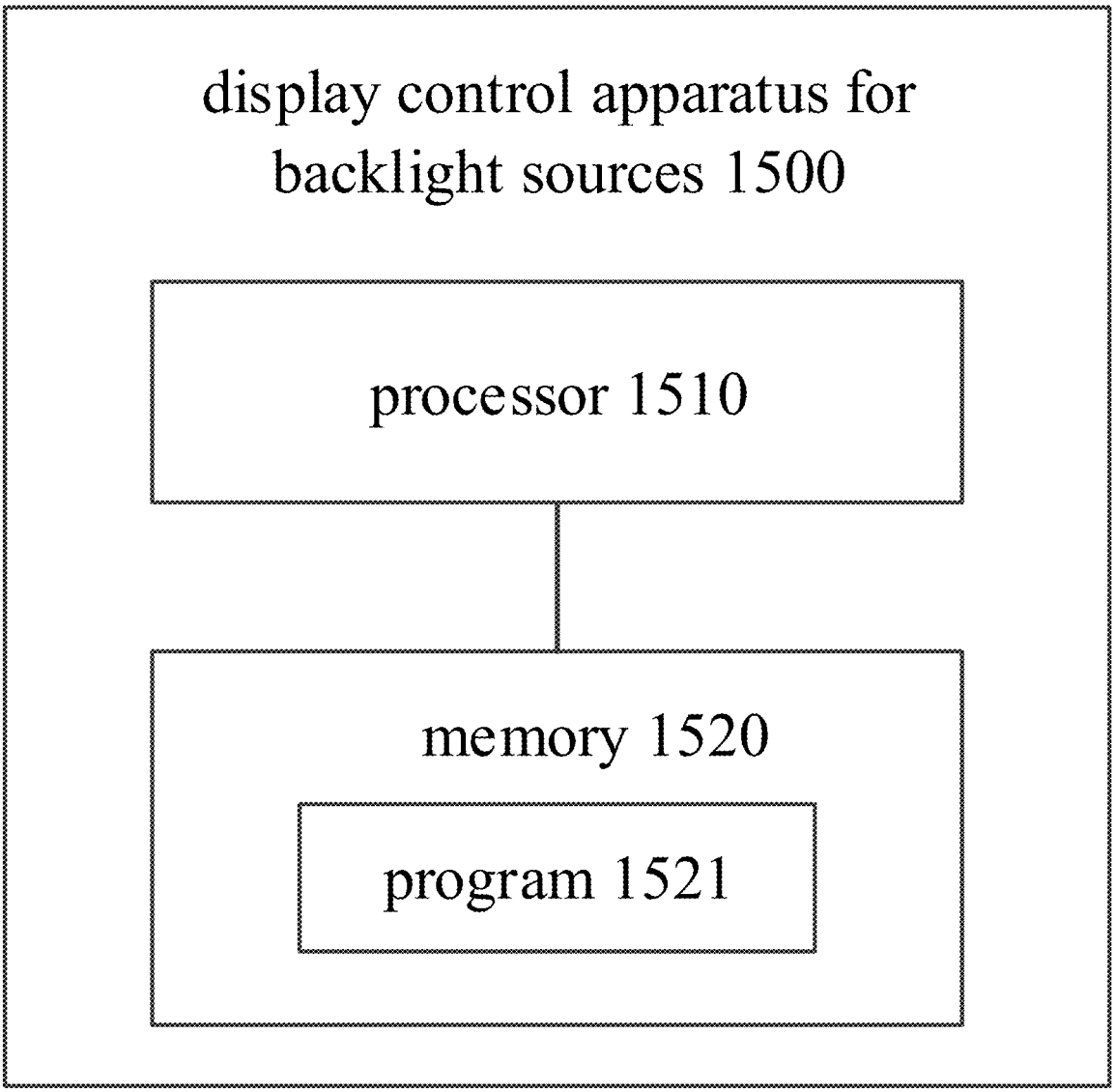
FIG. 15 is block diagram of a structure of another display control apparatus for backlight sources according to an embodiment of the present disclosure.

The present disclosure further provides a display control apparatus of backlight sources, which is applied to a display device including a display panel and a backlight module. The backlight module includes a plurality of backlight sources and a plurality of backlight areas, each of which is provided with one backlight source; and an area, corresponding to each of the backlight areas, on the display panel comprises a plurality of pixel points. As shown in FIG. 15, the apparatus 500 includes:

one or more processors 1510; and a memory 1520;

wherein the memory stores therein one or more programs 1521 configured to be executed by the one or more processor. The one or more programs include instructions that, when executed by the processor, implement the above display control methods in the present disclosure.

The present disclosure further provides a computer-readable storage medium, wherein the computer-readable storage medium is a non-volatile readable storage medium and stores instructions therein that, when the readable storage medium operates in a processor, cause the processor to perform the above display control methods in the present disclosure. For example, the computer-readable storage medium may be an ROM, a random access memory (RAM), a CD-ROM, a tape, a soft disk, an optical storage device, etc.

According to the display control apparatus and the display device of the present disclosure, by accurately modeling the backlight diffusion and storing the backlight source diffusion transmission parameter of the backlight module of the display device, the diffusion weights of A*B effective backlight sources that affect the luminance of the pixel point to the pixel point may be obtained conveniently, which facilitates the calculation of the equivalent backlight luminance of each pixel point accurately and quickly in the local dimming display process. Thus, a smoothly transitional W*H backlight distribution approximating the actual luminance of the backlight diffusion is obtained, thereby obtaining a corresponding LCD compensation image and achieving the same or even better display effect as a full-backlight display. According to the present disclosure, the luminance of the image is closer to the actual luminance of the original image within a non-low-grayscale range, and the image distortion is reduced, accompanied with good image quality, high contrast, low distortion, and no block and boundary lines.

It should be noted that in the description of the specification, the description of reference terms such as "an embodiment", "some embodiments", "an example", "a specific example" and "some examples" intends to mean that the specific features, structures, materials or characteristics described in combination of the embodiment(s) or example(s) are included in at least one embodiment or example of the present disclosure. In the specification of the present disclosure, illustrative description of the above terms does not necessarily refer to the same embodiment(s) or example(s). Furthermore, the specific features, structures, materials or characteristics as described can be combined in a proper manner in any one or several embodiments or examples. In addition, in the absence of contradiction, one skilled in the art can combine different embodiments or examples described in this specification and the features shown in different embodiments or examples.

In addition, the terms "first" and "second" are used for a descriptive purpose only and shall not be construed as indicating or implying relative importance or implicitly indicating the number of the technical features as indicated. Thus, features defined by "first" and "second" may explicitly or implicitly include at least one of the features. In the description of the present disclosure, "a plurality of" means two or more, for example, two or three, unless expressly limited otherwise.

One ordinary skilled in the art may understand that all or part of the steps carried in the methods in the above embodiments may be implemented by relevant hardware instructed by programs. The programs may be stored in a computer-readable storage medium. When the programs are executed to perform one or a combination of the steps of the method embodiments.

In the description, any process or method descriptions described in flowcharts or otherwise herein may be understood as representing modules, segments or portions of codes that include one or more executable instructions for implementing the steps of a particular logical function or process. In addition, the scope of the preferred embodiments of the present disclosure includes further implementations in which functions may be performed generally simultaneously or in an inverse sequence according to the involved functions, rather than the sequence shown or discussed, which should be understood by those skilled in the art of the embodiments of the present disclosure.

Logic and/or steps which are represented in the flowcharts or otherwise described herein, for example, a sequencing table of executable instructions that may be deemed for implementing logic functions, may be specifically implemented in any computer-readable medium, for the use of an instruction executing system, apparatus or device (such as a computer-based system, a system comprising a processor, or other systems that may acquire instructions from the instruction executing system, apparatus or device and execute the instructions), or for the use in combination with the instruction executing systems, apparatuses or devices. In respect of the present specification, the "computer-readable medium" may be any apparatus that can contain, store, communicate, disseminate, or transmit the programs for the use of the instruction executing systems, apparatuses or devices, or for the use in combination with the instruction executing systems, apparatuses or devices It should be understood that the parts of the present disclosure may be implemented by hardware, software, firmware, or a combination thereof. In the above embodiments, multiple steps or methods may be implemented by software or firmware stored in a memory and executed by a suitable instruction executing system. For example, if the steps or methods are implemented by hardware, as in another embodiment, they may be implemented by using any one or a combination of the following techniques well known in the art: a discrete logic circuit having a logic gate circuit that can be used to implement logic functions of data signals, an application-specific integrated circuit with a suitable combinational logic gate circuit, a programmable gate array (PGA), a field programmable gate array (FPGA), and the like.

Although embodiments of the present disclosure have been shown and described above, it should be understood that the above embodiments are exemplary only and cannot be understood to limit the present disclosure. Persons of ordinary skill in the art may make changes, modifications, substitutions, improvements and variations within the scope of the present disclosure.

What is claimed is:

1. A display control method of backlight sources, which is applied to a display device comprising a display panel and a backlight module, wherein the backlight module comprises a plurality of backlight sources and a plurality of backlight areas, each of which is provided with one backlight source; and an area, corresponding to each of the backlight areas, on the display panel comprises a plurality of pixel points; the method comprising:

determining a set backlight value of each backlight area according to a grayscale of an image to be displayed;

determining an equivalent backlight luminance of each pixel point according to a backlight source diffusion transmission parameter of the backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image;

wherein said determining the compensation image according to the equivalent backlight luminance of each pixel point comprises:

calculating a compensation value $v_{com}$ of each pixel point in the compensation image according to the equivalent backlight luminance of each pixel point through a compensation value calculation formula, wherein the compensation value calculation formula is:

$$v_{com} = 255 * \left[ \frac{\frac{\text{light}_{ideal} * 240}{bl} - \text{light}_{min}}{\text{light}_{max} - \text{light}_{min}} \right]^{1/gamma}, \text{ wherein,}$$

$$\text{light}_{ideal} = \left(\frac{v_{ori}}{255}\right)^{gamma} * (\text{light}_{max} - l_{en}) + l_{en}$$

in which $\text{light}_{ideal}$ represents a target luminance, $v_{ori}$ represents a maximum value among RGB three channels of the image to be displayed, gamma is an index of a relationship curve between the grayscale and the luminance, $\text{liqht}_{max}$ represents a maximum luminance value of a high-dynamic range system, $l_{en}$ represents an ambient luminance, $\text{light}_{max}$ and $\text{light}_{min}$ represent luminance values when all backlights are turned on and turned off respectively, and bl represents an equivalent backlight luminance expressed in grayscale.

2. The display control method of the backlight sources according to claim 1, wherein said determining the set backlight value of each backlight area according to the grayscale of the image to be displayed comprises:

determining a backlight statistical value of each backlight area according to the grayscale of the image to be displayed; and segmenting the backlight statistical value of each backlight area to obtain the set backlight value of each backlight area.

3. The display control method of the backlight sources according to claim 1, wherein the backlight source is a 4-bit backlight source, and said segmenting the backlight statistical value of each backlight area to obtain the set backlight value of each backlight area comprises:

segmenting the backlight statistical value of each backlight area to obtain the set backlight value of each backlight area according to a set backlight value calculation formula, wherein the set backlight value calculation formula is:

$$BL_{set} = \begin{cases} 240 & BL_{sta} \geq 240 \\ \left[\frac{BL_{sta}}{16}\right]_{floor} * 16 & 240 > BL_{sta} > 16 \\ 16 & 1 < BL_{sta} \leq 16 \\ 0 & BL_{sta} = 0 \end{cases},$$

wherein, $BL_{set}$ represents the set backlight value, $BL_{sta}$ represents the backlight statistical value, and $[\ ]_{floor}$ represents a rounding down operation.

4. The display control method of the backlight sources according to claim 1, wherein said determining the equivalent backlight luminance of each pixel point according to the backlight source diffusion transmission parameter of the backlight module of the display device and the set backlight value of each backlight area comprises:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the determined diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area, and taking the total diffusion luminance as the equivalent backlight luminance of the pixel point.

5. The display control method of the backlight sources according to claim 4, wherein said determining the diffusion weights of A*B effective backlight sources that affect a luminance of the pixel point to the pixel point comprises:

calling the backlight source diffusion transmission parameter of the backlight module of the display device, wherein the backlight source diffusion transmission parameter is a point spread function y=f(x) that characterizes a relationship between a diffusion luminance y and a diffusion distance x;

determining the A*B effective backlight sources that affect the luminance of the pixel point according to the point spread function y=f(x); and determining the diffusion weights of the A*B effective backlight sources to the pixel point according to distances from the pixel point to the A*B effective backlight sources through the point spread function.

6. The display control method of the backlight sources according to claim 5, further comprising:

obtaining illumination diffusion data of each backlight source of a plurality of backlight sources from different backlight areas of the display device, wherein the illumination diffusion data of each backlight source includes: luminance data of a plurality of pixel points on a screen of the display device and distance data representing a distance from a position of each pixel point to a position of a turned-on backlight source when each backlight source is turned on individually;

setting a luminance of a pixel point as a diffusion luminance y, setting a distance between a position of the pixel point and a backlight source as a diffusion distance x, and establishing a point spread function y=f(x) that characterizes the relationship between the diffusion luminance y and the diffusion distance x; and performing fitting to the point spread function according to the data corresponding to each pixel point to obtain various parameters in the point spread function, and taking the point spread function as the backlight source diffusion transmission parameter.

7. The display control method of the backlight sources according to claim 6, wherein said performing fitting to the point spread function according to the data corresponding to each pixel point to obtain various parameters in the point spread function comprises:

removing data corresponding to the pixel points whose luminance is less than a first luminance threshold from the illumination diffusion data, and taking the pixel points whose luminance is greater than or equal to the first luminance threshold as the effective pixel points, to obtain the data corresponding to the effective pixel points; and performing fitting to the point spread function according to the data corresponding to each effective pixel point to obtain various parameters in the point spread function.

8. The display control method of the backlight sources according to claim 7, wherein said performing fitting to the point spread function according to the data corresponding to each effective pixel point to obtain various parameters in the point spread function comprises:

performing statistical analysis on the data corresponding to each effective pixel point to obtain an average value of the diffusion luminance corresponding to each diffusion distance as an average diffusion luminance of each diffusion distance; and performing curve fitting according to each diffusion distance and the average diffusion luminance of each diffusion distance to obtain the various parameters in the point spread function.

9. The display control method of the backlight sources according to claim 7, wherein the point spread function y=f(x) is a piecewise polynomial function:

$$f(x)=\begin{cases}\sum_{n=0}^{k} a_n x^n & 0 \le x \le d1 \\ \sum_{n=0}^{k} b_n x^n & d1 < x \le d2\end{cases},$$

wherein, k is a polynomial order, $a_n$ and $b_n$ are coefficients, d1 is a decomposition distance of the piecewise polynomial function, d2 is a maximum diffusion distance, which is a distance between a backlight source and an effective pixel point farthest from the backlight source, x is a diffusion distance, and y is a diffusion luminance.

10. The display control method of the backlight sources according to claim 6, wherein when each backlight source is turned on individually, the luminance data of the plurality of pixel points on the screen of the display device includes: luminance data of a plurality of pixel points at a plurality of different distances to the position of the turned-on backlight source in a horizontal direction and a vertical direction of the position of the turned-on backlight source, and the distance data representing the distance from the position of each pixel point to the position of the backlight source includes: distance data representing distances from a plurality of pixel points at a plurality of different distances to the turned-on backlight source in the horizontal direction and the vertical direction of the position of the turned-on backlight source.

11. The display control method of the backlight sources according to claim 4, wherein said determining the diffusion weights of A*B effective backlight sources that affect the luminance of the pixel point to the pixel point according to the backlight source diffusion transmission parameter comprises:

calling the backlight source diffusion transmission parameter of the backlight module of the display device, wherein the backlight source diffusion transmission parameter is the diffusion weights of the A*B effective backlight sources to the pixel point; and determining the diffusion weights of A*B effective backlight sources that affect the luminance of the pixel point to the pixel point according to the called backlight source diffusion transmission parameters.

12. The display control method of the backlight sources according to claim 11, further comprises:

obtaining illumination diffusion data of each backlight source of a plurality of backlight sources from different backlight areas of the display device, wherein the illumination diffusion data of each backlight source includes: luminance data of a plurality of pixel points on a screen of the display device and distance data representing a distance from a position of each pixel point to a position of a turned-on backlight source when each backlight source is turned on individually;

setting a luminance of a pixel point as a diffusion luminance y, setting a distance between a position of the pixel point and a backlight source as a diffusion distance x, and establishing a point spread function y=f(x) that characterizes a relationship between the diffusion luminance y and the diffusion distance x; and performing fitting to the point spread function according to the data corresponding to each pixel point to obtain various parameters in the point spread function;

determining the A*B effective backlight sources that affect the luminance of the pixel point according to the point spread function y=f(x);

determining the diffusion weights of the A*B effective backlight sources to the pixel point according to distances from the pixel point to the A*B effective backlight sources through the point spread function; and taking the diffusion weights of the A*B effective backlight sources to the pixel point as the backlight source diffusion transmission parameter.

13. The display control method of the backlight sources according to claim 4, wherein said determining the target diffusion weights of the A*B effective backlight sources to the pixel point according to the determined diffusion weights of the A*B effective backlight sources to the pixel point comprises:

taking the determined diffusion weights of the A*B effective backlight sources to the pixel point as the target diffusion weights of the A*B effective backlight sources to the pixel point; and determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point comprises:

obtaining the total diffusion luminance of the A*B effective backlight sources at the pixel point according to the target diffusion weights of the A*B effective backlight sources to the pixel point through an equivalent backlight luminance calculation formula, and taking the total diffusion luminance as the equivalent backlight luminance B $L_{equ}$ of the pixel point, wherein the equivalent backlight luminance calculation formula is:

$$BL_{equ}=\sum_{i=1}^{A}\sum_{j=1}^{B} f(x_{i,j})L_{i,j},$$

wherein $x_{i,j}$ represents the distance between an pixel point (i,j) and each effective backlight source, $f(x_{i,j})$ represents the diffusion weight of each effective backlight source to the pixel point (i,j), $L_{i,j}$ represents a luminance reference value of each effective backlight source, the luminance reference value is determined according to set backlight value of the backlight area where the effective backlight source is, and the pixel point (i,j) is any pixel point on the display panel.

14. The display control method of the backlight sources according to claim 4, wherein said determining the target diffusion weights of the A*B effective backlight sources to the pixel point according to the determined diffusion weights of the A*B effective backlight sources to the pixel point comprises:

performing normalization on the determined diffusion weights of the A*B effective backlight sources to the pixel point according to a normalization calculation formula to obtain a normalized diffusion weight of the A*B effective backlight sources to the pixel point;

taking the normalized diffusion weight of the A*B effective backlight sources to the pixel point as the target diffusion weights of the A*B effective backlight sources to the pixel point; and determining the total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point comprises:

obtaining the total diffusion luminance of the A*B effective backlight sources at the pixel point according to the normalized diffusion weight of the A*B effective backlight sources to the pixel point through an equivalent backlight luminance calculation formula and taking the total diffusion luminance as the equivalent backlight luminance $BL_{equ}$ of the pixel point, wherein the normalization calculation formula is:

$$weight(i, j) = f(x_{i,j})/\text{sum_weight}, \ \text{sum_weight} = \sum_{i=1}^{A}\sum_{j=1}^{B} f(x_{i,j});$$

the equivalent backlight luminance calculation formula is:

$$L_{equ} = \sum_{i=1}^{A}\sum_{j=1}^{B} weight(i, j)L_{i,j};$$

in which $x_{i,j}$ represents the distance between a pixel point (i,j) and each effective backlight source, $f(x_{i,j})$ represents the diffusion weight of each effective backlight source to the pixel point (i,j), weight(i,j) represents the normalized diffusion weight of each effective backlight source to the pixel point, $L_{i,j}$ represents a luminance reference value of each effective backlight source, the luminance reference value is determined according to set backlight value of the backlight area where the effective backlight source is, and the pixel point (i,j) is any pixel point on the display panel.

15. A computer-readable storage medium, wherein the computer-readable storage medium is a non-volatile readable storage medium and stores instructions therein that, when the computer-readable storage medium operates in a processor, cause the processor to perform the display control method of backlight sources according to claim 1.

16. A display device, comprising a direct-lit backlight source, a display panel, a memory and one or more processors, wherein the memory stores therein one or more programs configured to be executed by the one or more processors, the one or more programs comprising instructions for performing following operations:

determining a set backlight value of each backlight area according to a grayscale of an image to be displayed;

determining an equivalent backlight luminance of each pixel point according to the backlight source diffusion transmission parameter of a backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image;

wherein said determining the compensation image according to the equivalent backlight luminance of each pixel point comprises:

calculating a compensation value $v_{com}$ of each pixel point in the compensation image according to the equivalent backlight luminance of each pixel point through a compensation value calculation formula, wherein the compensation value calculation formula is:

$$v_{com} = 255^{*}\left[\frac{\frac{light_{ideal} * 240}{bl} - light_{min}}{light_{max} - light_{min}}\right]^{1/gamma},$$

wherein, $$light_{ideal} = \left(\frac{v_{ori}}{255}\right)^{gamma} * (light_{max} - l_{en}) + l_{en}$$

in which $light_{ideal}$ represents a target luminance, $v_{ori}$; represents a maximum value among RGB three channels of the image to be displayed, gamma is an index of a relationship curve between the grayscale and the luminance, $liqht_{max}$ represents a maximum luminance value of a high-dynamic range system, $l_{en}$ represents an ambient luminance, $light_{max}$ and $light_{min}$ represent luminance values when all backlights are turned on and turned off respectively, and bl represents an equivalent backlight luminance expressed in grayscale.

17. The display device according to claim 16, wherein the one or more programs further comprise instructions for performing following operations:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the determined diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point.

18. A display control apparatus of backlight sources, which is applied to a display device comprising a display panel and a backlight module, wherein the backlight module comprises a plurality of backlight sources and a plurality of backlight areas, each of which is provided with one backlight source; and an area, corresponding to each of the backlight areas, on the display panel comprises a plurality of pixel points; the apparatus comprising:

one or more processors; and a memory;

wherein the memory stores therein one or more programs configured to be executed by the one or more processors, the one or more programs comprising instructions for performing following operations:

determining a set backlight value of each backlight area according to a grayscale of an image to be displayed;

determining an equivalent backlight luminance of each pixel point according to the backlight source diffusion transmission parameter of the backlight module of the display device and the set backlight value of each backlight area, wherein the backlight source diffusion transmission parameter is used to implement one of following functions: describing a relationship between a diffusion luminance corresponding to a pixel point and a backlight source luminance of each backlight area, and calculating a relationship between a diffusion luminance corresponding to a pixel point and a backlight source luminance of each backlight area;

determining a compensation image according to the equivalent backlight luminance of each pixel point; and controlling the backlight module to turn on the backlight sources according to the set backlight value of each backlight area, and controlling the display panel to display the image according to the compensation image;

wherein said determining the compensation image according to the equivalent backlight luminance of each pixel point comprises:

calculating a compensation value $v_{com}$ of each pixel point in the compensation image according to the equivalent backlight luminance of each pixel point through a compensation value calculation formula, wherein the compensation value calculation formula is:

$$v_{com} = 255 * \left[ \frac{\frac{light_{ideal} * 240}{bl} - light_{min}}{light_{max} - light_{min}} \right]^{1/gamma},$$

$$light_{ideal} = \left(\frac{v_{ori}}{255}\right)^{gamma} * (light_{max} - l_{en}) + l_{en}$$

in which $light_{ideal}$ represents a target luminance, $v_{ori}$; represents a maximum value among RGB three channels of the image to be displayed, gamma is an index of a relationship curve between the grayscale and the luminance, $liqht_{max}$ represents a maximum luminance value of a high-dynamic range system, $l_{en}$ represents an ambient luminance, $liqht_{max}$ and $liqht_{min}$ represent luminance values when all backlights are turned on and turned off respectively, and bl represents an equivalent backlight luminance expressed in grayscale.

19. The display control apparatus of backlight sources according to claim 18, wherein the one or more programs further comprise instructions for performing following operations:

determining diffusion weights of A*B effective backlight sources that affect a luminance of the pixel point to the pixel point according to the backlight source diffusion transmission parameters, wherein A and B are positive integers;

determining target diffusion weights of the A*B effective backlight sources to the pixel point according to the determined diffusion weights of the A*B effective backlight sources to the pixel point; and determining a total diffusion luminance of the A*B effective backlight sources at the pixel point according to the target diffusion weights of the A*B effective backlight sources to the pixel point and the set backlight value of each backlight area and taking the total diffusion luminance as the equivalent backlight luminance of the pixel point.

* * * * *